US010001719B2

(12) United States Patent
Kihara et al.

(10) Patent No.: US 10,001,719 B2
(45) Date of Patent: Jun. 19, 2018

(54) IMAGE FORMING APPARATUS

(71) Applicant: CANON KABUSHIKI KAISHA, Tokyo (JP)

(72) Inventors: Takayoshi Kihara, Mishima (JP); Kosuke Ikada, Numazu (JP); Masataka Mochizuki, Mishima (JP); Norihito Naito, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/281,397

(22) Filed: Sep. 30, 2016

(65) Prior Publication Data

US 2017/0097585 A1 Apr. 6, 2017

(30) Foreign Application Priority Data

Oct. 5, 2015 (JP) ..... 2015-197846

(51) Int. Cl.
*G03G 15/02* (2006.01)
*G03G 15/00* (2006.01)

(52) U.S. Cl.
CPC ..... *G03G 15/0266* (2013.01); *G03G 15/0275* (2013.01); *G03G 15/55* (2013.01); *G03G 2215/00071* (2013.01)

(58) Field of Classification Search
CPC ..... G03G 15/0266; G03G 15/55; G03G 15/0275; G03G 2215/00071
See application file for complete search history.

(56) References Cited

U.S. PATENT DOCUMENTS 5,805,951 A * 9/1998 Kato ..... G03G 15/55 399/169
8,543,021 B2 9/2013 Sakata et al.
2012/0002989 A1* 1/2012 Sakata ..... G03G 15/0266 399/48

FOREIGN PATENT DOCUMENTS

JP 2004157501 A 6/2004
JP 2011118234 A 6/2011
JP 2012013881 A 1/2012

* cited by examiner

*Primary Examiner* — Carla Therrien
(74) *Attorney, Agent, or Firm* — Rossi, Kimms & McDowell LLP

(57) ABSTRACT

An image forming apparatus includes: an acquisition portion that acquires, based on a current value detected by a detection unit, a discharge start voltage value between a photosensitive body and a charging member, in a voltage value of a voltage applied to the charging member, the discharge start voltage value being acquired from at least one of a plurality of measurement regions set by dividing an image forming region of the photosensitive body, in which an electrostatic image is formed, into a plurality of regions in a longitudinal direction orthogonal to a recording material conveyance direction; and a control portion that performs unevenness suppression control to reduce unevenness, in the longitudinal direction, of density of a developer image transferred onto the recording material based on the discharge start voltage value.

27 Claims, 18 Drawing Sheets

CHARACTERISTICS OF CHARGING ALTERNATING CURRENT VOLTAGE AND CHARGING CURRENT

Va'
Va
Δ V(=Va' −Va)
Δ V(=Va' −Va)
TIME(t)

Vb
TIME(t)

POTENTIAL IN LONGITUDINAL DIRECTION OF PHOTOSENSITIVE DRUM (Vac1<Vac2<vac3)

IMAGE FORMING APPARATUS

BACKGROUND OF THE INVENTION

Field of the Invention

The present invention relates to an image forming apparatus employing an electrophotographic image forming system.

Description of the Related Art

Conventionally, an image forming step performed in an image forming apparatus employing an electrophotographic system includes evenly charging the surface of a drum-type electrophotographic photosensitive body (hereinafter called a photosensitive drum) at a prescribed potential. For charging, a contact charging system has been recently mainstream in which a roller charging member (hereinafter called a charging roller) is, for example, brought into contact with the surface of a photosensitive drum and a voltage is applied to the charging roller to charge the photosensitive drum. As methods for applying a voltage to a charging roller, there have been known a method for applying a direct current voltage and a method for superimposing an alternating current voltage on a direct current voltage and alternately generating a discharge on positive and negative sides to uniformize a charge. In the latter method, a resistive load current flowing to the resistive load between a charging roller and a photosensitive drum, a capacitive load current flowing to the capacitive load between the charging roller and the photosensitive drum, and a discharge current between the charging roller and the photosensitive drum flow, and a current in which these currents are added together flows to the charging roller. In this case, it is known from experience that setting a discharge current amount at a prescribed value or more makes it possible to obtain a stable charge.

FIG. 18 shows the characteristics of a current Ic that flows to a charging roller when an alternating current voltage Vc is applied to the charging roller. The alternating current voltage Vc indicates the peak voltage value of an alternating current voltage, and the current Ic indicates the effective value of an alternating current. It can be seen from FIG. 18 that together with a gradual increase in the amplitude of the alternating current voltage Vc, a charging current increases concomitantly. When the alternating current voltage Vc is twice or less a prescribed voltage Vh, the amplitude of the alternating current voltage and the charging current are approximately proportional to each other. This is because a resistive load current and a capacitive load current are proportional to the amplitude of the voltage and also because a discharge phenomenon does not occur since the amplitude of the voltage is small and so a discharge current does not flow. Then, as the alternating current voltage is further increased, the discharge phenomenon starts to occur at a point where the prescribed voltage Vh is doubled. At this point, the charging current Ic starts to deviate from being proportional to the alternating current voltage Vc, and its flow increases by an amount corresponding to a discharge current Is. Here, in order to obtain a stable charge, it is necessary to set the alternating current voltage Vc such that the discharge current Is is a prescribed value or more.

However, when the amount of a discharge from a charging roller to a photosensitive drum increases, there are cases that the degradation of the photosensitive drum such as scraping of the photosensitive drum is accelerated and an abnormal image based on image deletion, etc. under high temperature and high humidity due to a discharge product occurs. Accordingly, in order to solve the above problems, it is necessary to obtain a stable charge and control the application of a minimum voltage so as to suppress a discharge amount as much as possible. In reality, however, the relationship between a voltage applied to a photosensitive drum and a discharge amount is not always constant and changes depending on the film thickness of the photosensitive layer or the dielectric layer of the photosensitive drum, the environmental variation of a charging member or air, or the like. It has been known that problems that accompany a change in a discharge amount are associated not only with a reason including the above environmental variation but also with a resistance value variation due to the manufacturing fluctuation or stain of a charging member, the electrostatic capacitance variation of a photosensitive drum due to durability, the characteristics fluctuation of the high pressure generation device of an image forming apparatus body, or the like.

In order to suppress such a change in a discharge amount, "discharge current control methods" such as that indicated in Japanese Patent Application Laid-open No. 2004-157501 have been proposed. In addition, as described above, electric characteristics of a photosensitive body change depending on the use environment or the manner in which it is used. Particularly, it has been known that a change in film thickness results in a change in image density and affects the density or the like of an output image, which causes a change in an image. Japanese Patent Application Laid-open Nos. 2011-118234 and 2012-13881 have each proposed a method for detecting a discharge start voltage according to the Paschen's law to easily detect the potential state of a photosensitive body as a method for detecting the potential state of the surface of a photosensitive drum.

However, along with the long service life of an image forming apparatus or the diversification of a using method in the market that has been developed in recent years, there has been a case that unevenness occurs in the stain of a charging roller or a change in the film thickness of a photosensitive drum in a longitudinal direction. The problem is likely to occur, for example, when a biased image is continuously formed by a printing unit in a direction (hereinafter called a longitudinal direction) perpendicular to an image formation processing direction (the conveyance direction of a recording material). Besides, the problem is likely to occur when a small recording material such as an envelope and a postcard is continuously used in an image forming apparatus having a system in which a photosensitive drum and a recording material such as a sheet directly come in contact with each other.

After the above biased printing or the feeding of small recording materials is performed for a long period of time, the occurrence of unevenness in the longitudinal direction of the film thickness of a photosensitive drum results in different impedance in the longitudinal direction, whereby a difficulty in discharging is made different for each part in the longitudinal direction. According to the above discharge current control method, a discharge amount in an entire longitudinal direction is detected. Therefore, there are a part where a discharge amount is smaller than an appropriate amount or a part where a discharge amount is greater than the appropriate amount and a scraping amount of a photosensitive drum is increased. When the unevenness of film thickness in a longitudinal direction occurs with an increase in the scraping amount of a photosensitive drum, the potential state of a laser exposure unit is made different. The potential difference of the exposure unit results in a difference in development contrast, and thus development performance is made different in the longitudinal direction.

Accordingly, when an appropriate potential for image formation is not evenly obtained in the longitudinal region of the photosensitive drum, an image failure such as density unevenness occurs in the longitudinal direction.

It is preferable to foresee the unevenness of the film thickness of a photosensitive drum in advance to determine a discharge amount, but there is a case that the foreseeing is difficult since such a phenomenon greatly changes depending on the use conditions of a user.

SUMMARY OF THE INVENTION

It is an object of the present invention to provide a technology capable of effectively suppressing an image forming failure.

In addition, it is another object of the present invention to provide an image forming apparatus comprising:

a photosensitive body on which an electrostatic image used to form a developer image to be transferred onto a recording material is formed;

a charging member that is arranged close to or in contact with the photosensitive body and charges the photosensitive body with a voltage applied thereto;

a voltage application unit that applies the voltage to the charging member;

an exposure unit that exposes the photosensitive body;

a detection unit that detects a current value of a current flowing to the charging member;

an acquisition portion that acquires, based on the current value detected by the detection unit, a discharge start voltage value, at which a discharge starts between the photosensitive body and the charging member, in a voltage value of the voltage applied to the charging member, the discharge start voltage value being acquired from at least one of a plurality of measurement regions set by dividing an image forming region of the photosensitive body, in which the electrostatic image is formed, into a plurality of regions in a longitudinal direction orthogonal to a conveyance direction of the recording material; and a control portion that performs unevenness suppression control to reduce unevenness, in the longitudinal direction, of density of the developer image transferred onto the recording material based on the discharge start voltage value acquired by the acquisition portion.

Further features of the present invention will become apparent from the following description of exemplary embodiments (with reference to the attached drawings).

DESCRIPTION OF THE EMBODIMENTS

The following provides a detailed exemplary explanation of embodiments of this invention based on examples with reference to the drawings. However, the dimensions, materials, shapes and relative arrangement of constituent components described in the embodiments may be suitably modified according the configuration and various conditions of the apparatus to which the invention is applied. Namely, the scope of this invention is not intended to be limited to the following embodiments.

First Embodiment

As a specific example of an image forming apparatus according to an embodiment of the present invention, an image forming apparatus employing an electrophotographic system such as a copier, a printer, and a facsimile machine has been known. In such an image forming apparatus, the present invention configures a measurement region having a prescribed range in a longitudinal direction (direction orthogonal to the conveyance direction of a recording material) at the surface of a photosensitive drum. By the detection (acquisition) (detection of a partial discharge start voltage) of a discharge start voltage value in the measurement region, the unevenness of film thickness in the longitudinal direction of the photosensitive layer of the photosensitive drum is detected (acquired). The present invention is characterized in that desired control is performed based on the detection result to reduce unevenness, in the longitudinal direction, of the density of a developer image transferred onto the recording material and suppress the occurrence of an image forming failure.

(Configurations of Image Forming Apparatus and Process Cartridge and Outline of Operation)

Figure 2:
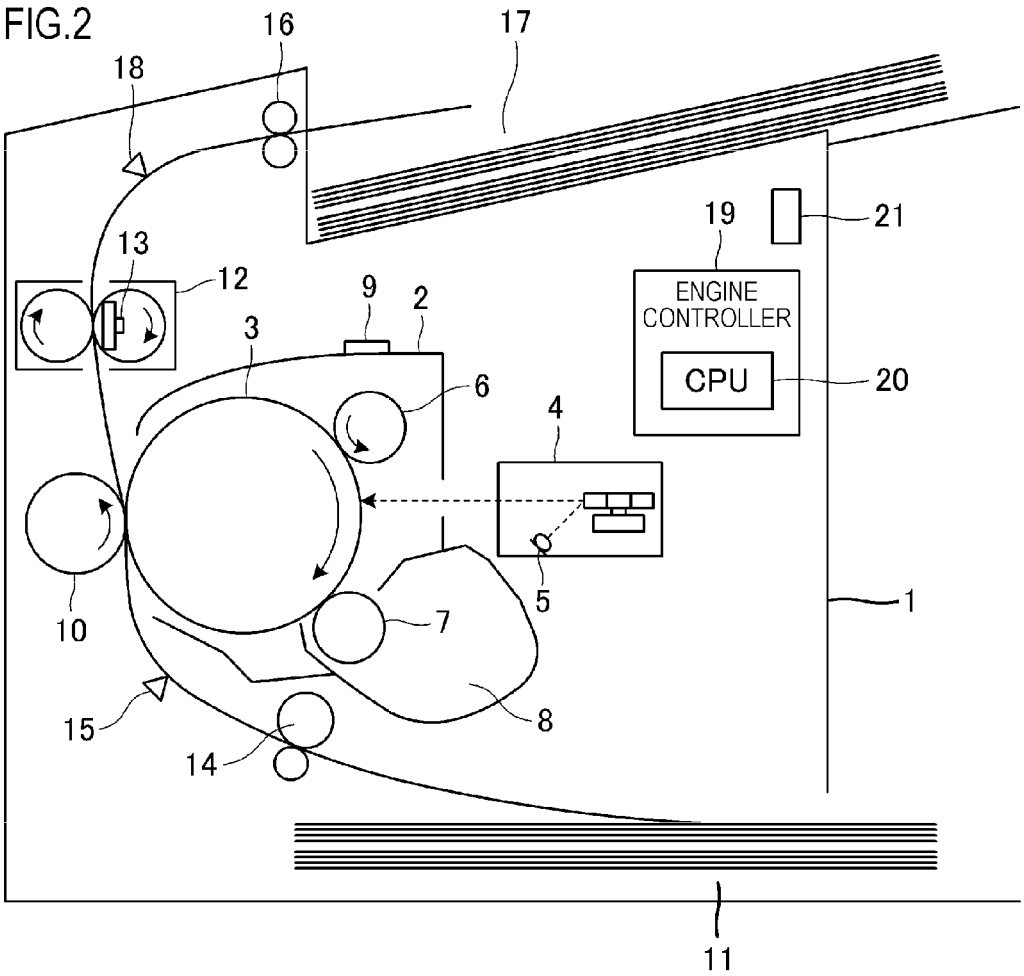
FIG. 2 is a schematic view of an image forming apparatus according to the embodiment of the present invention.

FIG. 2 is a schematic cross-sectional view of an image forming apparatus 1 according to the embodiment of the present invention. The image forming apparatus 1 is provided with a photosensitive drum 3 serving as a photosensitive body or an image supporting body and a laser scanner 4 (exposure unit) that applies a laser beam onto the photosensitive drum 3 with a semiconductor laser 5. In addition, the image forming apparatus 1 is provided with a charging roller 6 serving as a charging member or a charging portion that evenly charges the photosensitive drum 3, a development roller 7 serving as a developer supporting body that develops an electrostatic latent image (latent image) formed on the photosensitive drum 3 with a developer, and a development unit 8 that stores the developer. The photosensitive drum 3, the charging roller 6, the development roller 7, the development unit 8, and a non-volatile memory 9 that stores various information are integrally configured as a process cartridge 2. The process cartridge 2 is configured to be attachable/detachable to/from (replaceable with respect to) the apparatus body of the image forming apparatus 1. Here, the apparatus body of the image forming apparatus 1 indicates constituents that do not include the process cartridge 2 in the image forming apparatus 1.

Moreover, the image forming apparatus 1 is provided with a transfer roller 10 that transfers a developer image developed on the photosensitive drum 3 onto a recording material 11, a fixation unit 12 that fixes the developer transferred onto the recording material 11 with heat and pressure, and a temperature thermistor 13 that controls the temperature of the fixation unit 12. Further, the image forming apparatus 1 is provided with a sheet feeding roller 14 that feeds the recording material 11 and a top sensor 15 that synchronizes the conveyance of the recording material 11 and the rotation of the photosensitive drum 3 with each other. Furthermore, the image forming apparatus 1 is provided with a sheet ejection roller 16 that ejects the recording material 11 where a developer image has been fixed (the recording material 11 where an image has been formed) onto a sheet catching tray 17, and a sheet ejection sensor 18 that detects the presence or absence of the recording material 11 where a developer image has been fixed. Furthermore, the image forming apparatus 1 is provided with an engine controller 19 that is provided with a CPU 20 (control portion) and controls each of the above constituents, and an environmental sensor 21 that detects the outside environment of the image forming apparatus 1.

(Control of Charging Portion)

Figure 3:
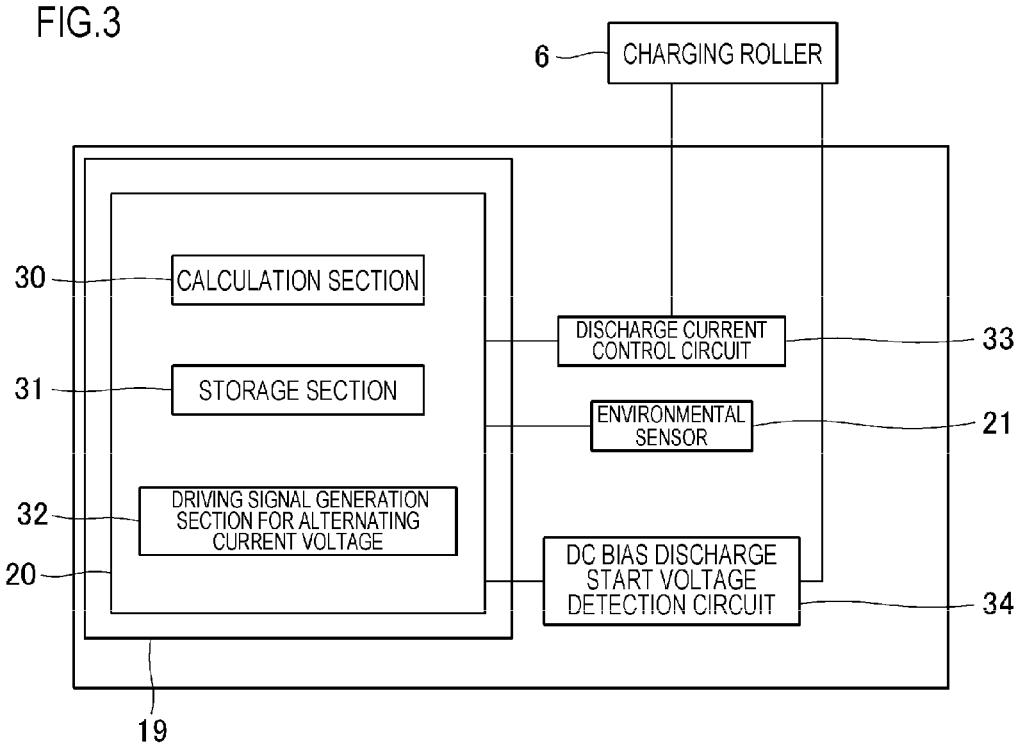
FIG. 3 is a block diagram of discharge current control.

FIG. 3 is a block diagram for controlling the charging portion of the image forming apparatus according to the embodiment. The CPU 20 has a calculation section 30, a storage section 31, and a driving signal generation section 32 for an alternating current voltage. When receiving a signal from the CPU 20, a discharge current control circuit 33 (voltage application unit) applies a voltage to the charging roller 6 while controlling a discharge current. The CPU 20 detects an output value of the environmental sensor 21 and controls the discharge current control circuit 33 according to the output value. The detailed operation of the discharge current control circuit 33 will be described later.

(Discharge Current Control)

Figure 4:
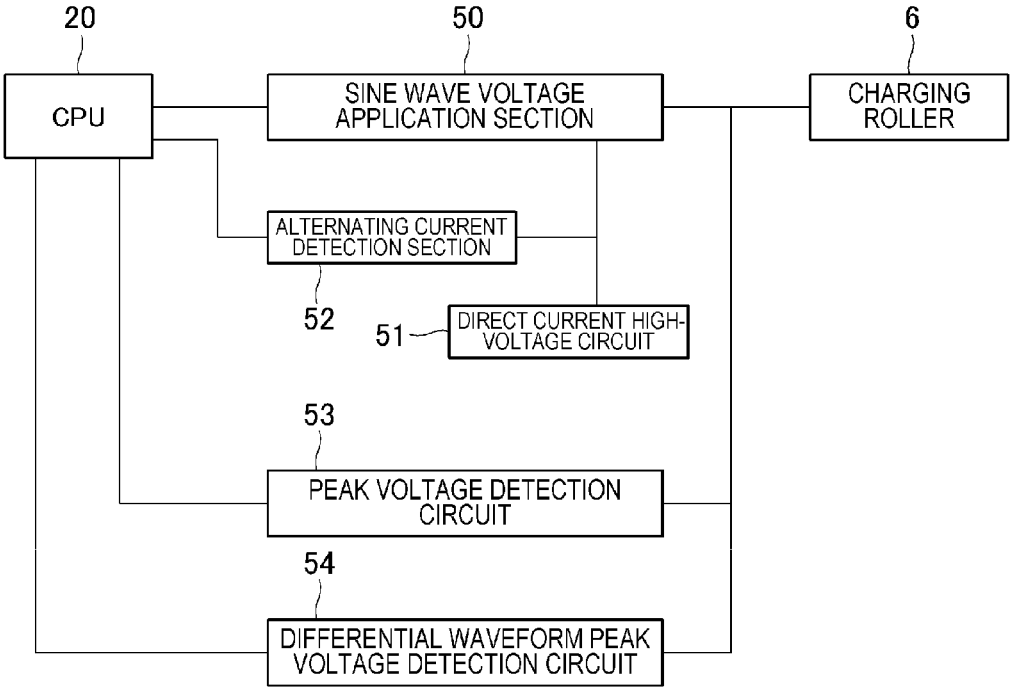
FIG. 4 is a circuit diagram of the discharge current control.

FIG. 4 is a circuit diagram of the discharge current control circuit 33 in the embodiment. In the discharge current control circuit 33, an alternating current high voltage of a sine wave generated by a sine wave voltage application section 50 is superimposed on a direct current voltage output from a direct current high-voltage circuit 51. The vibration voltage is supplied to the charging roller 6. In addition, an alternating current value is controlled such that a constant vibration voltage output level is obtained, according to a detected output value of the alternating current detection section 52 serving as an alternating current value detection unit. Moreover, the discharge current control circuit 33 has a peak voltage detection circuit 53 serving as a voltage amplitude value detection section and a differential waveform peak voltage detection circuit 54 serving as a differential amplitude value detection section. Thus, the CPU 20 is allowed to detect the peak value and the differential waveform peak value of an output alternating current voltage.

Figure 5:
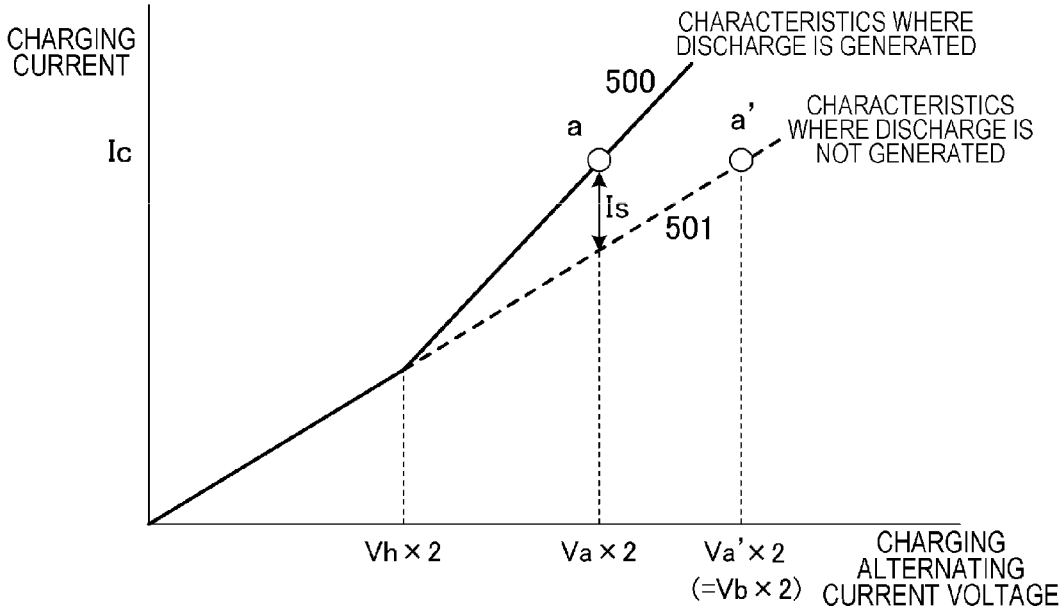
FIG. 5 is an explanatory diagram of a discharge current detection method.

FIG. 5 is a graph for describing a method for detecting a discharge current in the embodiment, in which the peak value of an alternating current voltage applied to the charging roller 6, the peak value of a differential waveform, and the characteristics of a charging alternating current value are shown. As shown in FIG. 5, in a region in which a charging alternating current voltage is twice or less a discharge start voltage (Vh), the relational expression between a charging current value and a charging alternating current voltage is indicated by an approximately proportional line passing through an origin. In the region, a current corresponding to the resistive load and the capacitive load between the charging roller 6 and the photosensitive drum 3 flows. Conversely, in a region in which the charging alternating current voltage is twice or more the discharge start voltage (Vh), a discharge current is generated between the charging roller 6 and the photosensitive drum 3, and a charging current value Ic to which the value of the discharge current has been added flows. In the discharge start region, characteristics where a discharge is generated are indicated by symbol 500, and characteristics where the discharge is not generated is indicated by symbol 501. Here, the value of the discharge current is calculated by the relationship between the characteristics 500 and the characteristics 501. In addition, a discharge current value Is is calculated by the following Expression (1) when a peak value where the discharge is generated is Va, a peak value where the discharge is not generated is Va', and the charging current value is Ic.

$$Is = Ic \times (Va' - Va)/Va' \quad \text{Expression (1)}$$

That is, with the understanding of (Va'−Va)/Va', it is possible to detect a discharge amount with respect to a charging current.

Figures 6A, 6B:
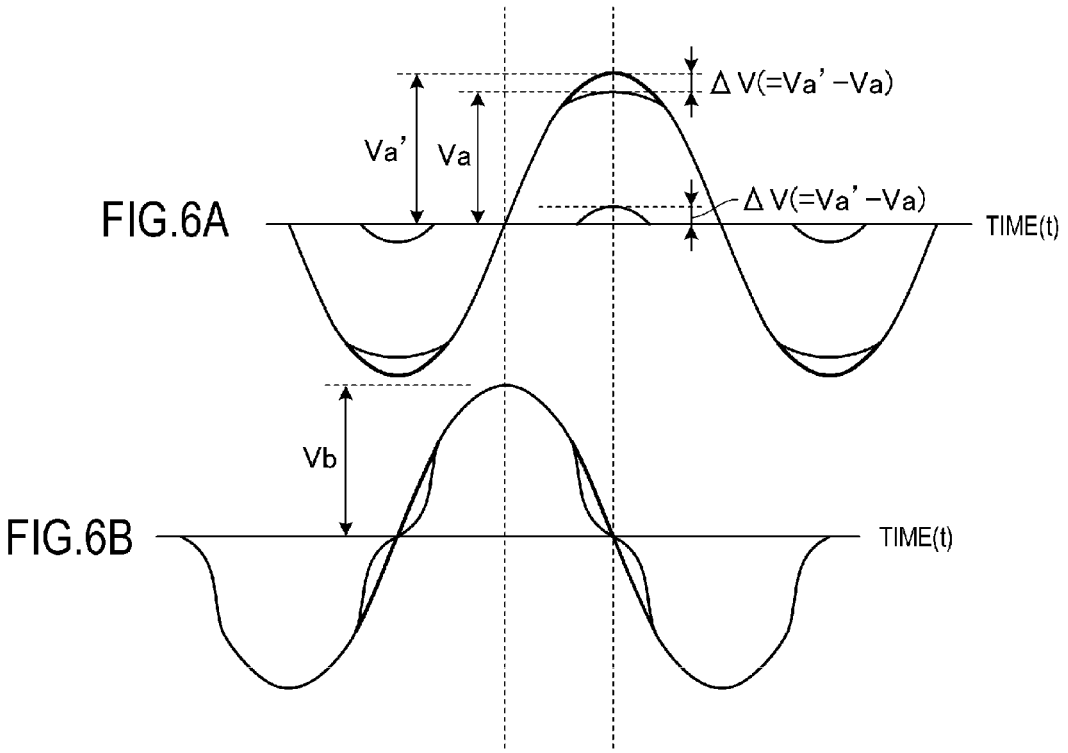
FIGS. 6A and 6B are waveform diagrams of detecting the discharge current control.

A description will be given, with reference to FIGS. 6A and 6B, of a method for calculating (Va'−Va)/Va'. FIGS. 6A and 6B show waveform diagrams of discharge current control detection in the embodiment. FIG. 6A shows a charging output waveform applied to the charging roller 6, and FIG. 6B shows the differential waveform of a charging output. The vertical axis shows an output waveform, and the horizontal axis shows a time. The output waveform of a charging voltage is formed into a shape in which the level near its peak decreases by ΔV (=(Va'−Va)) with the influence of a discharge. In addition, since the phase of the waveform of a differential voltage is delayed by 90°, its peak value is free from the discharge. Therefore, the peak value (Vb) of the differential voltage corresponds to the peak level (Va') of an output voltage when the discharge is not generated. For this reason, it is possible to calculate (Va'−Va)/Va'. In the method shown in FIGS. 5 and 6A and 6B, the charging current value Ic is adjusted to obtain the discharge current value Is.

(Method for Detecting Unevenness of Film Thickness in Longitudinal Direction)

In order to solve the above problems, a discharge start voltage value on the surface of the photosensitive drum 3 is partially detected in the longitudinal direction in the embodiment. Then, an exposure potential Vl on the surface of the photosensitive drum 3 is detected in the longitudinal direction based on the measurement results. Based on the relationship between the exposure potential Vl and film thickness T, a change in the film thickness in the longitudinal direction of the drum may be calculated. As a result, the unevenness of the film thickness in the longitudinal direction of the photosensitive drum 3 may be detected. The calculation of the above relationship is made possible when the relationship between the exposure potential Vl and the film thickness at a charging potential Vd is calculated in advance.

Here, the photosensitive drum 3 has a configuration in which a layer (photosensitive layer) made of a photoconductive substance such as a charge generation substance and a charge transport substance is formed on a supporting body. Hereinafter, the film thickness of the photosensitive drum 3 indicates the film thickness of the photosensitive layer. Note that as the configuration of the photosensitive drum 3, a conductive layer that covers the surface of a conductive supporting body and an intermediate layer having electrical shielding performance to prevent the injection of charges from the conductive layer to the photosensitive layer may be provided between the photosensitive layer and the supporting body. In addition, in the case of a lamination type photosensitive drum in which a charge generation layer containing a charge generation substance and a charge transport layer containing a charge transport substance are laminated to each other, the service life of the photosensitive drum is generally determined according to an amount of film thickness remaining after a surface layer (CT layer) serving as the charge transport layer is scraped. For example, in the case of a photosensitive drum in which a conductive layer having a thickness of about 30 μm, an intermediate layer and a charge generation layer having a thickness of about 1 μm, and a charge transport layer having a thickness of 15 μm are formed on a substrate body serving as a conductive supporting body such as an aluminum cylinder, the initial film thickness of the photosensitive drum is 15 μm. Note that the above configurations are given only for illustration purpose and thus the configuration of the photosensitive drum to which the present invention is applicable is not limited to the examples here.

Figure 12:
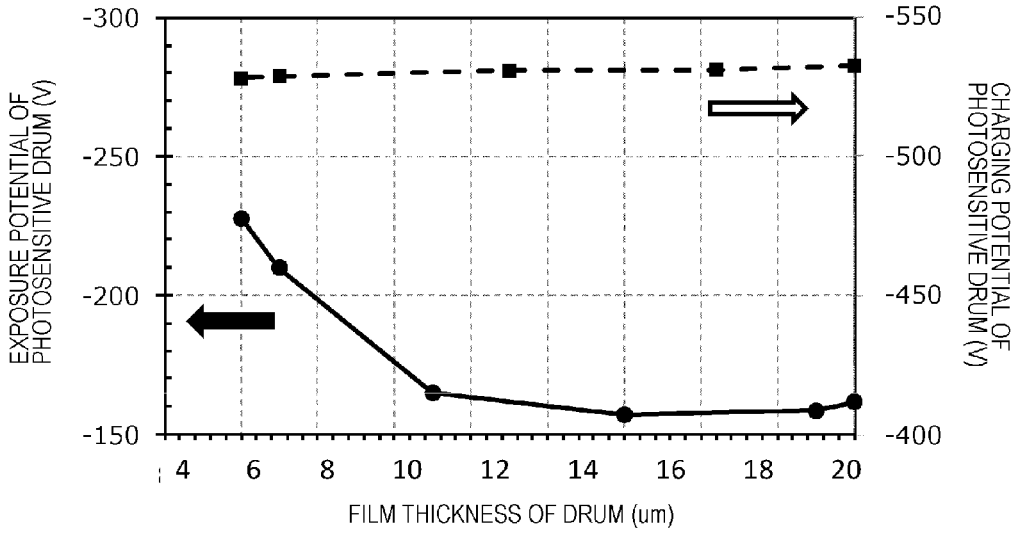
FIG. 12 is a correlation diagram of the charging potential, the exposure potential, and film thickness of the photosensitive drum.

FIG. 12 is a graph showing the relationship between the charging potential Vd and the exposure potential Vl with respect to the film thickness of the photosensitive drum. The horizontal axis indicates the film thickness T of the photosensitive drum 3, and the right vertical axis indicates the charging potential Vd, and the left vertical axis indicates the exposure potential Vl. A bias applied to the charging roller 6 was set at −550 V. In the graph, dotted lines indicate the charging potential Vd, and a solid line indicates the exposure potential Vl. Due to its dark attenuation amount of about 20 to 25 V in this case, the charging potential Vd is about −530 V. It is clear from FIG. 12 that the charging potential Vd is stable regardless of the film thickness T, while the exposure potential Vl greatly changes depending on the film thickness T. Particularly, a change amount of the exposure potential Vl is outstanding at a drum film thickness of 10 μm or less. Based on the relationship, the film thickness of the photosensitive drum may be detected by the measurement of the exposure potential Vl of a certain measurement region D of the photosensitive drum 3.

Next, a description will be given of a discharge information detection method necessary for detecting the film thickness of the photosensitive drum.

(Discharge Information Detection Method: Discharge Start Voltage Detection Method)

In the embodiment, a discharge start voltage value is used as discharge information to be detected by a discharge information detection unit. As shown in FIG. 3, the image forming apparatus according to the embodiment has a DC bias discharge start voltage detection circuit 34 (acquisition portion) to detect a discharge start voltage value as discharge information. When receiving a signal from the CPU 20, the DC bias discharge start voltage detection circuit 34 detects a discharge start voltage while applying a DC voltage to the charging roller 6.

Figure 7:
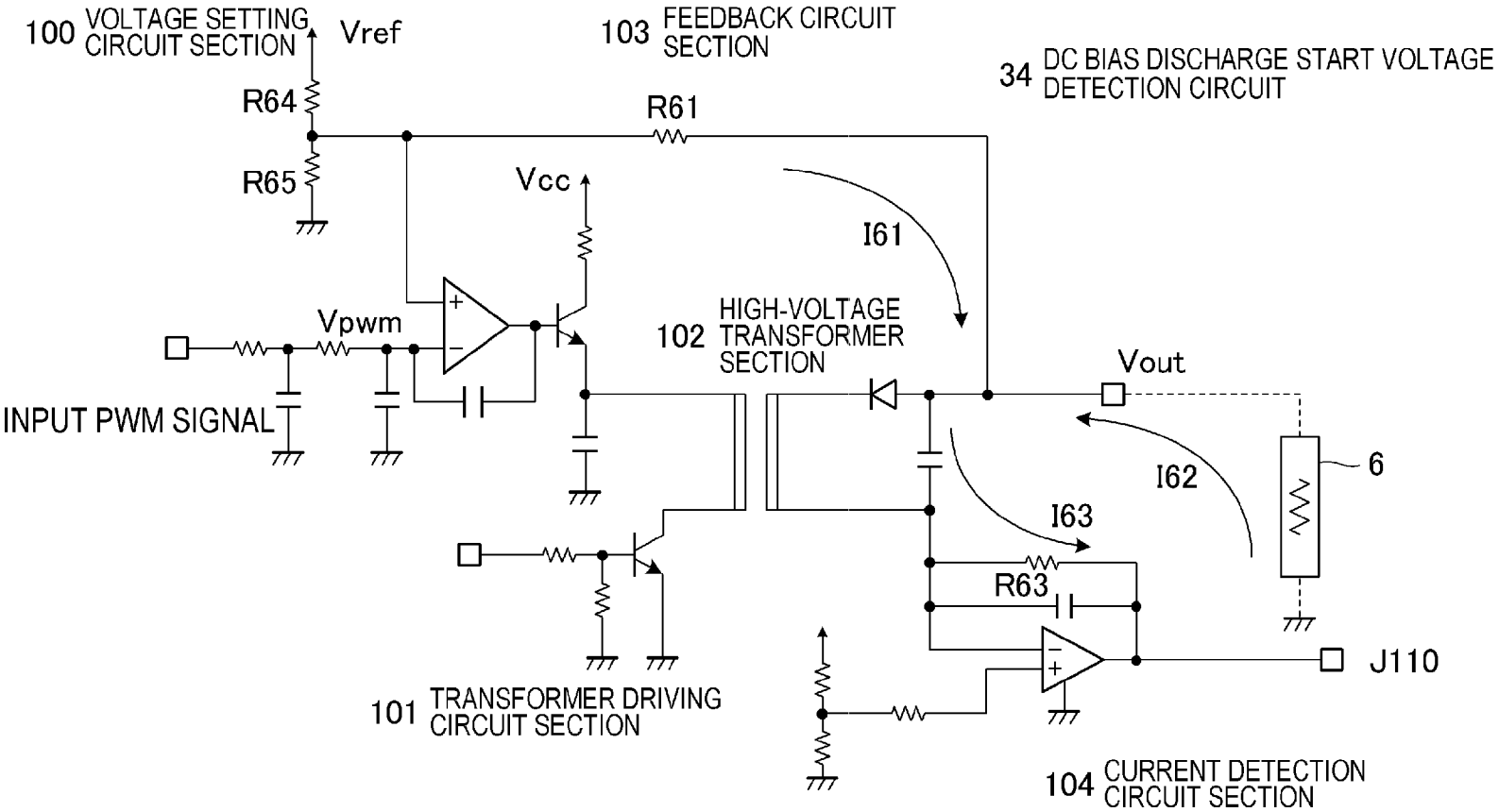
FIG. 7 is a circuit diagram of detecting a DC bias discharge start voltage.

FIG. 7 shows the schematic configuration of the DC bias discharge start voltage detection circuit 34 in the embodiment. The DC bias discharge start voltage detection circuit 34 is roughly provided with a voltage setting circuit section 100, a transformer driving circuit section 101, a high-voltage transformer section 102, a feedback circuit section 103, and a current detection circuit section (current detection unit) 104. The voltage setting circuit section 100 is configured to be capable of varying a bias value according to a PWM signal. The feedback circuit section 103 is provided to monitor an output voltage via a resistor R61 and generate an output voltage value according to the setting of the PWM signal. The current detection circuit section 104 detects a current value I63, which is obtained by adding together a current value I62 of a current flowing to the charging roller 6 and a current value I61 of a current flowing from the feedback circuit section 103, with a resistor R63 and transmits the detected current value I63 to the CPU 20 as an analog value via J110. Until a discharge starts between the photosensitive drum 3 and the charging roller 6, the photosensitive drum 3 and the charging roller 6 are insulated from each other. Therefore, until the discharge starts, the current of the current value I61 from the feedback circuit section 103 only flows to the detection resistor R63. The current value I61 is determined by Vpwm, Vref, R64, and R65 set in the PWM signal.

$$I61=(V\text{ref}-V\text{pwm})/R64-V\text{pwm}/R65$$

In addition, when the current of the current value I61 flows to the feedback resistor R61, the output voltage is also set.

$$V\text{out}=I61\times R61+V\text{pwm}\approx I61\times R61$$

Figure 8:
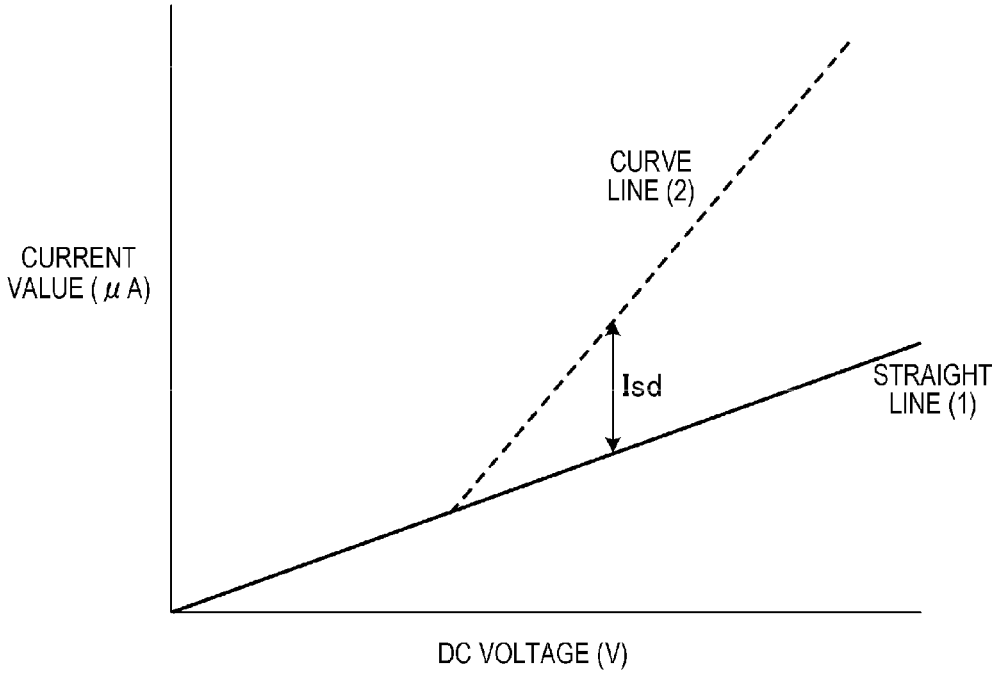
FIG. 8 is a schematic diagram of the V-I characteristics of a charging member.

FIG. 8 is a graph showing V-I characteristics in the embodiment. That is, as indicated by a line (1) in FIG. 8, only the current of the current value I61 corresponding to the PWM signal flows to the resistor R63 of the current detection circuit section until the discharge starts. However, when the discharge starts between the photosensitive drum 3 and the charging roller 6, the current of the current value I63 flows which is obtained by adding together the current value I62 of the current flowing to the charging body and the current value I61 of the current flowing from the feedback circuit section. That is, as shown in FIG. 8, a curved line (2) branched at a point at which the discharge starts is generated. Thus, a current flowing to the charging body may be calculated as Isd obtained by subtracting the line (1) from the curved line (2). Then, a voltage value at a point at which one of a plurality of currents Isd becomes a prescribed current value is determined as a DC bias discharge start voltage value.

In addition, in order to partially detect a discharge start voltage in the longitudinal direction of the photosensitive drum 3 (detect the discharge start voltage in a specific region in the longitudinal direction on the surface of the photosensitive drum 3), it is necessary to evenly charge the photosensitive drum 3 over its entirety in the longitudinal direction. To this end, the application of a charging alternating current voltage of a sufficient magnitude may be required. In the embodiment, a charging AC bias of a maximum value in the apparatus configuration is applied. In addition, a mechanism for confirming an even charging potential at the application of a voltage may be provided. Hereinafter, a description will be given of the mechanism for confirming an even charging potential.

First, a prescribed DC bias and a maximum AC bias are applied, and a DC bias discharge start voltage Vdcth1 (ave) in the entire longitudinal direction of the photosensitive drum 3 at that time is detected by the DC bias discharge start voltage detection circuit 34. Next, the AC bias (PWM) is stepped down by one, and the prescribed DC bias and the AC bias are similarly applied, and a DC bias discharge start voltage Vdcth2 (ave) in the entire longitudinal direction of the photosensitive drum 3 at that time is detected by the DC bias discharge start voltage detection circuit 34. When the capacitance of the photosensitive drum 3 is indicated by Cd and the capacitance between the charging roller 6 and the photosensitive drum 3 is indicated by C, the DC bias discharge start voltages in the entire longitudinal direction of the photosensitive drum 3 are expressed by the following expressions.

$$Vdcth1(\text{ave})=(1+C/Cd)Vpa+Vd1(\text{ave})$$

$$Vdcth2(\text{ave})=(1+C/Cd)Vpa+Vd2(\text{ave})$$

From the above two expressions, the following relational expression may be obtained.

$$Vdcth1(\text{ave})-Vdcth2(\text{ave})=Vd1(\text{ave})-Vd2(\text{ave})$$

Here, Vd1 (ave) indicates an average potential in the longitudinal direction of the surface potentials of the photosensitive drum 3 charged by the maximum AC bias. In addition, Vd2 (ave) indicates an average potential in the longitudinal direction of the surface potentials of the photosensitive drum 3 charged by the AC bias stepped down by one from the maximum setting value.

Figure 14A:
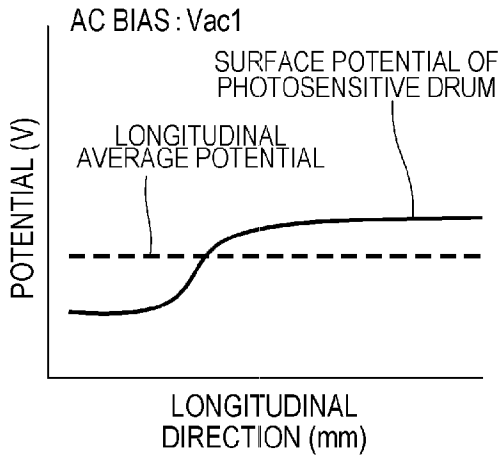
FIGS. 14A to 14C are diagrams each showing the relationship between an AC bias and the distribution in the longitudinal direction of the surface potentials of the photosensitive drum.
Figure 14B:
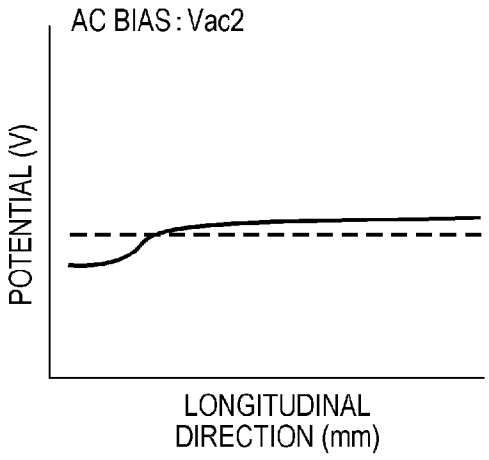
Figure 14C:
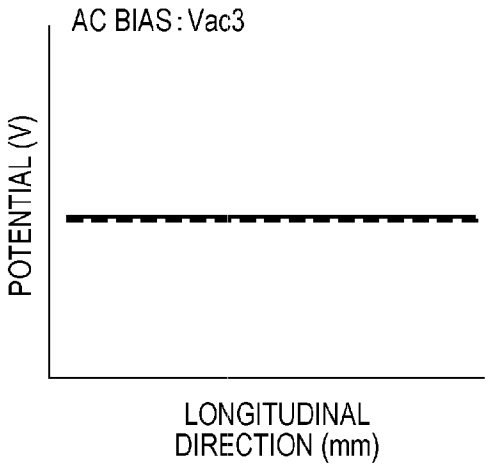

FIGS. 14A to 14C are graphs each showing the relationship between the distribution of surface potentials in the longitudinal direction of the photosensitive drum 3 and the AC bias. FIG. 14A shows a charging potential when a discharge is unevenly generated in the longitudinal direction. Charging with the AC bias secures a constant charging potential when a normal discharge and a reverse discharge are repeatedly generated. However, when the discharge is unevenly generated in the longitudinal direction, a low AC bias also causes the unevenness of charging in the longitudinal direction. FIG. 14B shows the charging potential when the AC bias is increased. As shown in FIG. 14B, a discharge amount increases in the entire longitudinal direction with an increase in the AC bias, and the potential of the photosensitive drum 3 is made even in the longitudinal direction. FIG. 14C shows the charging potential when the discharge is evenly generated in the longitudinal direction. As the AC bias is further increased, an average potential also increases. When the charging potential of the photosensitive drum 3 becomes even in the entire longitudinal direction, the average potential remains constant.

From this reason, the evenness of the charging potential may be confirmed by the comparison between Vdcth1 (ave) and Vdcth2 (ave). Specifically, when Vdcth1 is equal to Vdcth2, Vd1 is equal to Vd2. Therefore, it may be determined that the surface potential of the photosensitive drum 3 is made even in the longitudinal direction. Conversely, when Vdcth1 is not equal to Vdcth2, Vd1 is not equal to Vd2. Therefore, it is determined that the surface of the photosensitive drum 3 is not satisfactorily charged. In this case, it is determined that an image stable in quality may not be provided even if any voltage is applied. Therefore, it is necessary to notify a user of the fact that the process cartridge has come to the end of its service life.

Figure 9A:
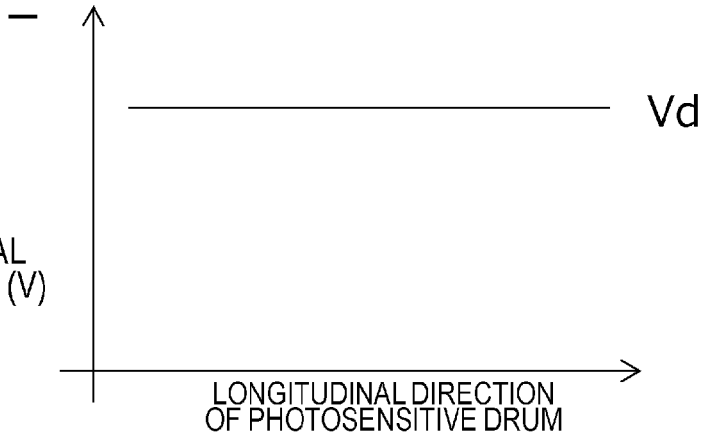
FIGS. 9A to 9C are schematic diagrams of the measurement of a partial discharge start voltage where an exposed part is a measurement region.
Figure 9B:
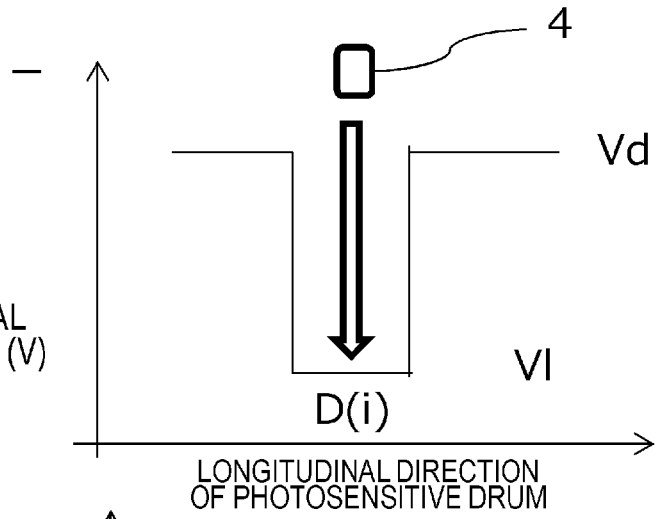
Figure 9C:
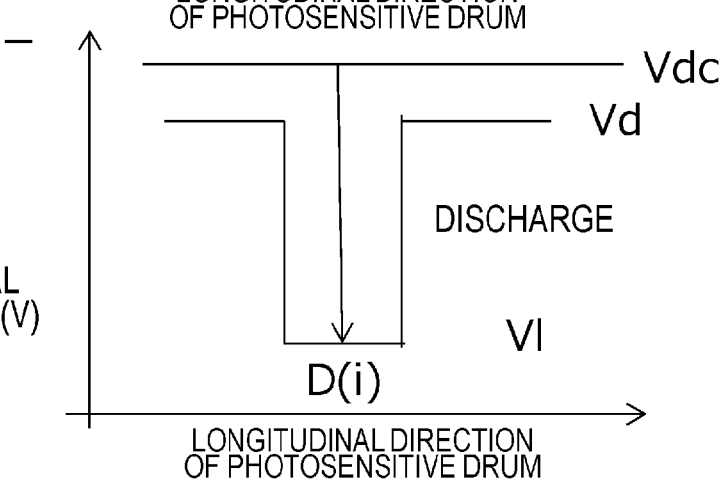

A description will be given, with reference to FIGS. 9A to 9C and FIGS. 10A to 10C, of a method for detecting the partial discharge start voltage in the longitudinal direction of the photosensitive drum 3. FIGS. 9A to 9C are graphs each describing a method for detecting the partial discharge start voltage when only a measurement region D(i) (one measurement region, from which the discharge start voltage value is to be acquired, among a plurality of measurement regions) is exposed. The horizontal axis indicates a position in the longitudinal direction of the photosensitive drum 3, the origin is set at one end position on the surface of the photosensitive drum 3, and the position moves from one end to the other end toward the advancing direction of the axis. In addition, the vertical axis indicates the surface potential of the photosensitive drum, and an absolute value becomes greater toward a negative direction as a numeric value with a negative polarity increases. That is, FIGS. 9A to 9C show a change (difference) in the surface potential along the longitudinal direction of the photosensitive drum 3.

First, as shown in FIG. 9A, the photosensitive drum 3 is evenly charged (charging potential: Vd). Next, as shown in FIG. 9B, only the measurement region D(i) is exposed by the laser scanner 4 to be set at the exposure potential (Vl). Then, as shown in FIG. 9C, a DC bias (Vdc) is applied to the charging roller 6 by the DC bias discharge start voltage detection circuit 34, and the DC bias discharge start voltage is measured while the exposure potential is partially applied. As a result, a DC bias discharge start voltage Vth1(i) (first discharge start voltage value) in the measurement region D(i) to which the exposure potential is applied is obtained.

At this time, the DC bias (Vdc) applied to the charging roller 6 is set at a value such that a difference in magnitude between the DC bias (Vdc) and the drum potential becomes smaller in the non-measurement regions than the measurement region D(i) and such that the DC bias is different in magnitude from both the drum potential of the measurement region D(i) and the drum potential of the non-measurement regions on the same polarity side. In the case of FIGS. 9A to 9C, the drum potential of the measurement region D(i) is set at the exposure potential (Vl), and the drum potential of the non-measurement regions is set at the charging potential (Vd). Accordingly, the DC bias (Vdc) having the magnitude close to that of the charging potential (Vd) and having a difference in magnitude from both the exposure potential (Vl) and the changing potential (Vd) on the same negative polarity side is applied. Thus, the discharge start voltage only for the measurement region may be calculated.

When consideration is given to an equivalent circuit with the photosensitive drum capacity of the measurement region D(i) as Cd(i) and the capacity between the charging roller 6 and the photosensitive drum 3 as C(i), the magnitude of the DC bias discharge start voltage is indicated by the following expression.

$$Vth1(i)=-(1+C(i)/Cd(i))Vpa-VL(i) \qquad \text{Expression (2)}$$

Here, Vpa indicates a Paschen voltage and the function of air pressure and the distance between discharges.

Figure 10A:
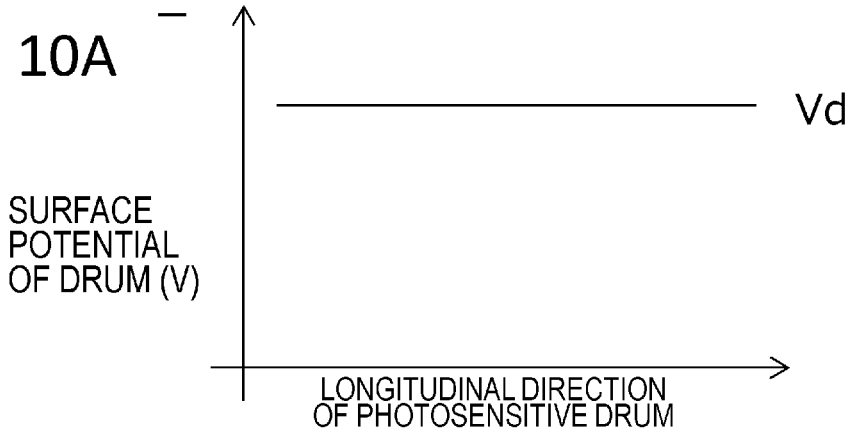
FIGS. 10A to 10C are schematic diagrams of the measurement of the partial discharge start voltage where non-exposed parts are measurement regions.
Figure 10B:
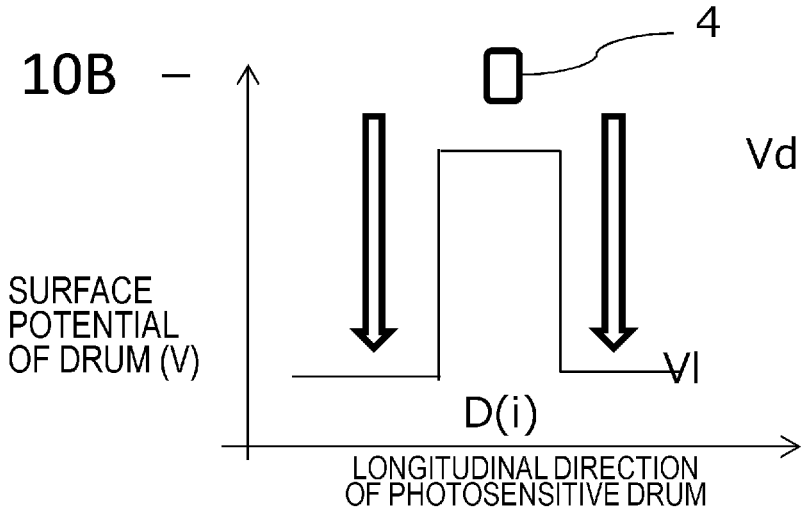
Figure 10C:
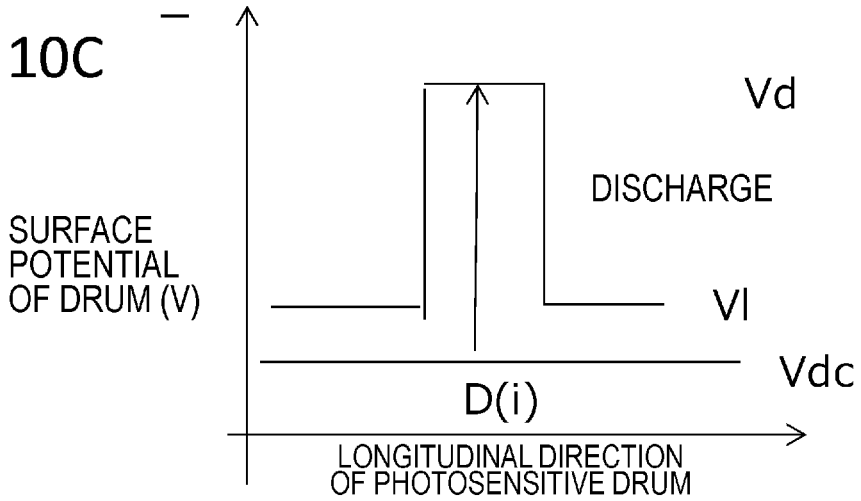

FIGS. 10A to 10C show a method for detecting the partial discharge start voltage when only the measurement region D(i) (the one measurement region, from which the discharge start voltage value is to be acquired, among the plurality of measurement regions) serves as a non-exposure part. The horizontal axis indicates a position in the longitudinal direction of the photosensitive drum 3. The vertical axis indicates the surface potential of the photosensitive drum 3, and an absolute value becomes greater toward a negative direction as a numeric value with a negative polarity increases. Unlike FIGS. 9A to 9C, a measurement region in which the partial discharge start voltage is detected serves as the non-exposure part, and non-measurement regions serve as exposure parts.

First, as shown in FIG. 10A, the photosensitive drum 3 is evenly charged (charging potential: Vd). Next, as shown in FIG. 10B, the parts other than the measurement region D(i) are exposed by the laser scanner 4 to be set at the exposure potential (Vl). Then, as shown in FIG. 10C, the DC bias (Vdc) is applied to the charging roller 6 by the DC bias discharge start voltage detection circuit 34, and the DC bias discharge start voltage is measured while the exposure potential is partially applied. As a result, a DC bias discharge start voltage Vth2(i) (second discharge start voltage value) of the measurement region D(i) where the exposure potential is formed is obtained.

At this time, the magnitude of the DC bias (Vdc) applied to the charging roller is set like the case described with reference to FIGS. 9A to 9C. That is, the DC bias (Vdc) is set at a value such that a difference in magnitude between the DC bias and the drum potential becomes smaller in the non-measurement regions than the measurement region D(i) and such that the DC bias is different in magnitude from both the drum potential of the measurement region D(i) and the drum potential of the non-measurement regions on the same polarity side. In the case of FIGS. 10A to 10C, the measurement region D(i) is set at the charging potential (Vd), and the non-measurement regions are set at the exposure potential (Vl). Accordingly, the DC bias (Vdc) having the magnitude close to that of the exposure potential (Vl) and having a difference in magnitude from both the charging potential (Vd) and the exposure potential (Vl) on the same positive polarity side is applied. Thus, the discharge start voltage may be calculated only in the measurement region.

Like the case described with reference to FIGS. 9A to 9C, the magnitude of the discharge start voltage may be calculated by the following expression.

$$Vth2(i)=(1+C(i)/Cd(i))Vpa-Vd \qquad \text{Expression (3)}$$

As described with reference to FIGS. 9A to 9C and FIGS. 10A to 10C, Vth1(i) and Vth2(i) may be calculated by measuring the respective discharge start voltages of the same measurement region D(i) with the exposure potential (Vl) and the charging potential (Vd) in the longitudinal direction of the photosensitive drum. Thus, the components of the photosensitive drum capacity Cd(i) in the measurement region D(i) and the capacity C(i) between the charging roller 6 and the photosensitive drum 3 may not be taken into consideration, and thus the exposure potential (Vl) of the measurement region D(i) may be accurately calculated. That is, the following expression (4) is obtained based on the above expressions (2) and (3).

$$\text{Expression (2)+Expression (3)}: \quad Vth1(i)+Vth2(i)=-(Vl(i)+Vd) \qquad \text{Expression (4)}$$

Then, the following expression (5) is obtained based on the above expression (4), whereby Vl(i) may be calculated.

$$Vl(i)=-(Vth1(i)+Vth2(i))-Vd \qquad \text{Expression (5)}$$

Accordingly, when the surface of the photosensitive drum 3 is divided into a plurality of regions in the longitudinal direction and the above step is performed for each of the regions, a change in Vl in the longitudinal direction (Vl(1), Vl(2), . . . , Vl(x)) may be accurately calculated.

Next, a description will be given of measurement regions in the longitudinal direction of the photosensitive drum in which the partial discharge start voltage is detected. The embodiment of the present invention is characterized in that the unevenness of film thickness in the longitudinal direction of the photosensitive drum is detected, and at least one measurement region having a prescribed range in the longitudinal direction is set.

Figure 11A:
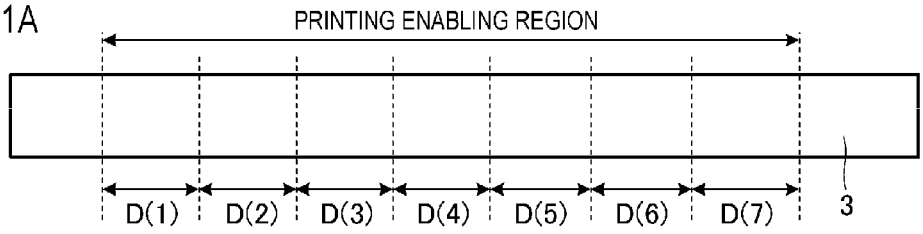
FIGS. 11A and 11B are explanatory diagrams of the measurement regions of a photosensitive drum in the embodiment of the present invention.
Figure 11B:
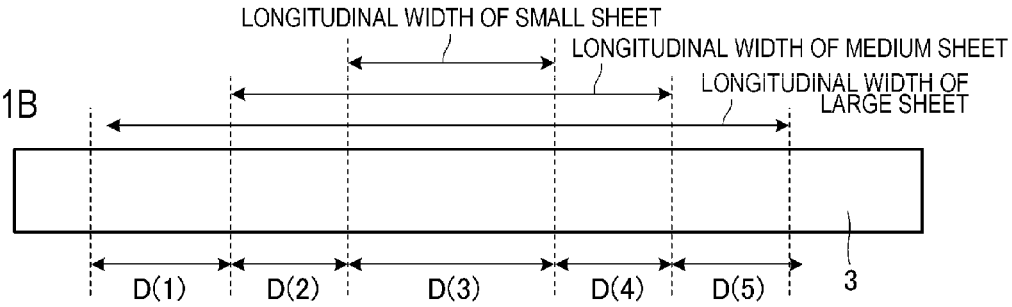

FIGS. 11A and 11B are diagrams each showing an example of the measurement regions of the photosensitive drum in the embodiment of the present invention. FIG. 11A is a diagram for describing a case in which an image forming region (print enabling region) on the surface of the photosensitive drum 3 is evenly divided into seven regions in the longitudinal direction and the above partial discharge start voltage is detected in each of the regions. As shown in FIG. 11A, when the image forming region is divided in the longitudinal direction to detect the partial discharge start voltage, Vl may be detected in each of the measurement regions D(i) (i=1 to 7). Then, based on the relationship shown in FIG. 12, the film thickness of the photosensitive layer in each of the measurement regions D(i) (i=1 to 7) may be calculated from Vl in each of the measurement regions D(i) (i=1 to 7). Thus, the scraping unevenness of film thickness in the longitudinal direction of the photosensitive layer of the photosensitive drum 3 may be detected based on the detection results of Vl. Note that a method for setting the measurement regions is not limited to the above method in which the image forming region is evenly divided into the regions.

FIG. 11B is a diagram for describing a case in which measurement regions are determined according to the sizes of sheets (recording materials) to be actually fed. As shown in FIG. 11B, when the respective measurement regions are determined according to small, medium, and large sheets, it becomes possible to perform measurement in consideration of a scraping amount of the photosensitive drum 3 caused by the feeding of the sheets and perform more accurate measurement. Even with such setting of the measurement regions, Vl(i) may be calculated in each of the measurement regions D(i).

As shown in FIGS. 11A and 11B, the embodiment describes the cases in which the measurement region D(i) is evenly divided into five to seven regions to calculate Vl in each of the plurality of regions in the longitudinal direction of the photosensitive drum 3. However, the unevenness of the film thickness of the photosensitive drum may be detected in such a way that at least one measurement region D(i) having a prescribed range in the longitudinal direction is set as the measurement region D(i), Vl is measured in the measurement region D, and the film thickness is detected.

In the embodiment, the discharge start voltage is used as discharge information and detected to detect the exposure potential Vl in each of the measurement regions. However, any detection method is available so long as the effect of detecting the exposure potential Vl in a desired measurement region is obtained. For example, a discharge current discharged from the charging roller 6 or the transfer roller 10 may be detected to detect the exposure potential Vl in a measurement region.

In addition, the embodiment describes the case in which the charging roller 6 is used as a charging member that is arranged close to or in contact with the photosensitive drum 3 and charges the photosensitive drum 3 with the application of a voltage. However, any conductive member other than the charging roller 6 may be used so long as the same effect is obtained. For example, the transfer roller (transfer member) 10 shown in FIG. 2, which generates a transfer bias between the transfer roller 10 and the photosensitive drum 3 with the application of a voltage, may be used.

(Control Based on Measurement Result of Discharge Information: Potential Control at Image Formation)

The embodiment describes the method for detecting the discharge information and accurately detecting the film thickness of the photosensitive drum based on detection results. Next, a description will be given of potential control at image formation as an example of desired control based on a detection result.

As surface potentials of the photosensitive drum 3 in an initial state, the charging potential Vd was set at −500 V, the exposure potential Vl was set at −150 V, and the development bias Vdc was set at −350 V. When the photosensitive drum 3 is continuously used, the development potential and the exposure potential Vl of the photosensitive drum 3 increase. If the photosensitive drum 3 remains the same, a development contrast may not be substantially secured, which results in a case that an image failure such as decline in density and reduction in tone occurs. Therefore, by the application of a varied charging bias and a development bias based on a detection result, it is possible to perform the same potential control as that performed on the photosensitive drum in the initial state.

For example, when 30,000 CS-680 A4 sheets were intermittently fed two by two at a printing ratio of 4%, the exposure potential Vl of the photosensitive drum 3 detected by the discharge information detection unit was −170 V. By increasing the applied charging bias and the development bias by −20 V based on the detection result, it is possible to perform image formation at the same development contrast as that of the photosensitive drum in the initial state.

In the embodiment, the charging bias and the development bias applied as the potential control at the image formation are varied to perform the potential control. However, any method may be used so long as the same effect is obtained. For example, the potential control at the image formation may be performed in such a way that a laser exposure amount is varied by the exposure unit based on a detection result to set the exposure potential Vl at an initial state.

A description will be given of a more specific applied example about a configuration as the feature of the embodiment in which the unevenness of the film thickness in the longitudinal direction of the photosensitive drum is detected by detecting the partial discharge start voltage and the suppression control of the unevenness of film thickness in the longitudinal direction of the photosensitive drum based on the detection result.

(Control after Detecting Film Thickness in Longitudinal Direction: Suppression Control of Unevenness of Film Thickness of Drum)

A scraping amount of the photosensitive drum 3 is determined by a current amount of a discharge generated by the charging of the charging roller 6 or the like and the contact pressure of a cleaning blade (cleaning member that comes in sliding contact with the surface of the rotating photosensitive drum 3 to remove toner from the surface). In the embodiment, a discharge current amount was set at 180 μA, and the contact pressure of the cleaning blade was set at 45 gf/cm under 23° C. and 50% RH. In addition, as described with reference to FIG. 12, it is found that a difference in the potential Vl of the exposure part becomes about 40 V or more when a difference in film thickness (difference in the film thickness between a region in which the film thickness is relatively large and a region in which the film thickness is relatively small) is 3 μm or more in a region in which the film thickness of the photosensitive drum 3 is 10 μm or less. It is found that a decline in density outstandingly occurs when a solid image is printed under this condition. That is, when a difference in the film thickness occurs in the longitudinal direction of the photosensitive drum 3 by 3 μm or more, the unevenness of density occurs between a high density part and a low density part. Moreover, there is a problem that the unevenness of the density hardly occurs at an initial use and the first half of a long time use but gradually becomes obvious with the accumulation of scraping amounts of the photosensitive drum.

In view of the problem, in the embodiment, the suppression control of the unevenness of the film thickness of the drum is performed when it is determined by the method for detecting the partial discharge start voltage that the film thickness of the photosensitive drum 3 becomes 10 μm or less (first threshold or less) and that the unevenness of the film thickness occurs in the longitudinal direction of the photosensitive drum 3 by 3 μm or more (second threshold or more).

As the suppression control of the unevenness of the film thickness of the drum, the photosensitive drum 3 is temporarily charged by the charging roller 6 after an image forming operation, and only the measurement region D(i), in which the film thickness of the drum is determined to be large, is exposed by the laser scanner 4. The DC bias is applied by the charging roller 6 to the exposed measurement region D(i) to be positively discharged to rotate the photosensitive drum 3. That is, a discharge amount is positively increased only at a part at which the film thickness of the drum is large to increase a scraping amount. Thus, a scraping amount of only a part in the longitudinal direction of the photosensitive drum 3 is increased, whereby the film thickness of the photosensitive drum 3 may be made substantially even in the longitudinal direction.

(Evaluation Conditions)

In the first embodiment, a resolution was set at 600 dpi, a process speed was set at 235 mm/sec, and a laser exposure amount was set at 2.0 mJ/m$^2$ under the environment of 23° C. and 50% RH as examination conditions. In addition, the toner with a negative polarity was used in the embodiment, but toner with a positive polarity may be used. In this case, the configuration remains the same except that all the symbols of a bias or the like are made opposite. As for measurement, 40,000 CS680 A6 sheets were intermittently fed two by two at a printing ratio of 4%, and one solid white image sheet and one solid black image sheet were printed every 5,000 sheets. Due to their small size, the sheets were set to be conveyed along a region close to one side in the longitudinal direction of the photosensitive drum 3. As an adverse effect on an image caused by the scraping unevenness of the photosensitive drum 3, density unevenness in the longitudinal direction was confirmed on the image. In order to confirm the adverse effect on the image, Xerox Business 4200 was used as an evaluation sheet. As the surface potentials of the photosensitive drum 3 in an initial state, the charging potential Vd was set at −500 V, the exposure potential Vl was set at −150 V, and the development bias Vdc was set at −350 V.

Figure 13:
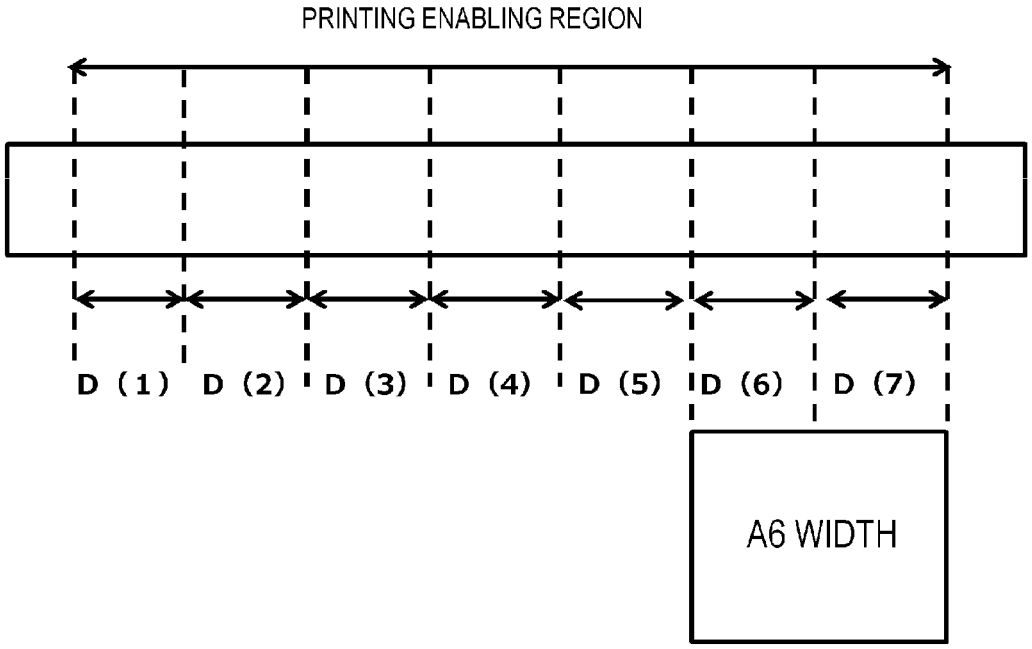
FIG. 13 is a schematic diagram showing measurement regions D and evaluation sheet feeding conditions in the first embodiment of the present invention.

FIG. 13 shows the measurement regions D and sheet feeding conditions in the first embodiment. In the first embodiment, the image forming region on the surface of the photosensitive drum 3 was divided into the seven regions in the longitudinal direction to form the measurement regions D(1) to D(7). The sheets are fed along a region overlapping with the measurement regions D(6) and D(7) of the photosensitive drum. That is, the toner was printed only at the measurement regions D(6) and D(7) when the recording sheets were fed.

When the suppression control of the unevenness of the film thickness of the drum was determined to be necessary, the rotation of the photosensitive drum 3 was extended for about four seconds at the subsequent rotation of the photosensitive drum 3 and the DC bias was applied to the measurement regions D(1) to D(5) of the photosensitive drum 3, in which the sheets had not been fed, to be charged and then exposed and developed to promote the scraping of the photosensitive drum 3. The rotation time of the photosensitive drum 3 at the subsequent rotation was set to be the same as the drum rotation time at which sheets were intermittently printed two by two in the present configuration. However, any operation may be performed so long as the same effect is obtained. For example, a drum rotation time may be further increased or a discharge amount may be increased to obtain the effect of scraping only a part where the film thickness of the drum is large.

In the suppression control of the unevenness of the film thickness of the drum in the first embodiment, the configuration in which the subsequent rotation of a print job is extended to suppress the unevenness of the film thickness of the drum is described. However, any configuration in which only a part where the film thickness of the drum is large is scraped may be used so long as the same effect is obtained. For example, the same processing may be performed in the pre-step of image formation, or the transfer roller 10 may be used instead of the charging roller 6.

(Flowchart of Suppression Control of Unevenness of Film Thickness in Longitudinal Direction)

Figure 1:
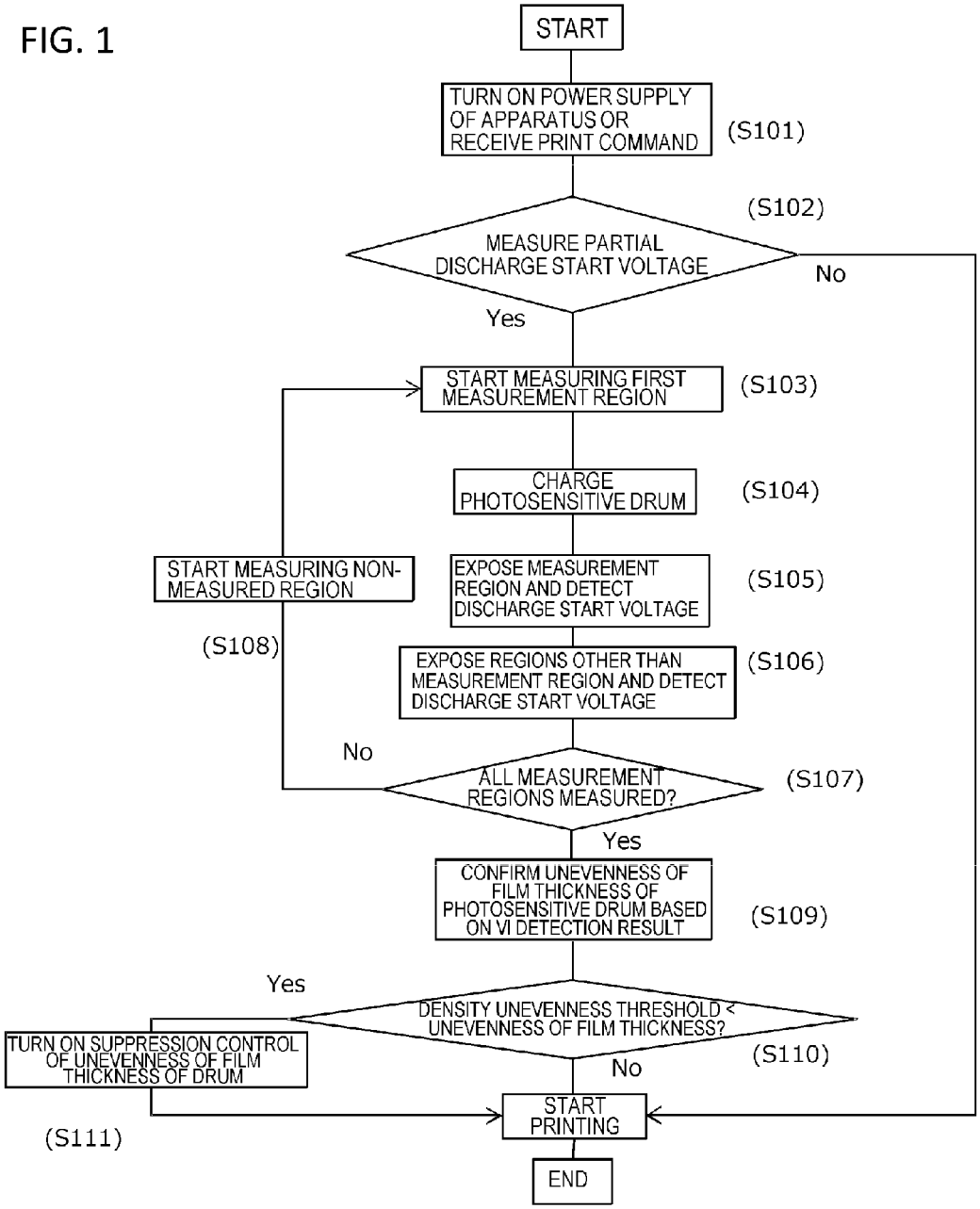
FIG. 1 is a flowchart of unevenness suppression control in a first embodiment of the present invention.

FIG. 1 is a flowchart for describing the detection of the partial discharge start voltage in the longitudinal direction of the photosensitive drum 3 and the suppression control of the unevenness of the film thickness in the longitudinal direction based on the result of the detection of the unevenness of the film thickness of the drum in the first embodiment of the present invention.

First, the power supply of the image forming apparatus 1 is turned on, or a print command is received (S101). Next, a determination is made as to whether the partial discharge start voltage is detected (S102). Since the unevenness of the film thickness in the longitudinal direction of the photosensitive drum 3 occurs with time, it is not necessary to measure the partial discharge start voltage at all times. In the embodiment, an image failure due to density unevenness accompanied by the scraping of the photosensitive drum 3 was likely to occur every 1,000 sheets or so. Therefore, the partial discharge start voltage was measured once every 1,000 sheets. Meanwhile, a printing operation starts based on the result of measurement most recently performed. Note that a measurement frequency may be appropriately set according to the configuration of the image forming apparatus.

When the partial discharge start voltage is measured, the measurement region D(1) is determined (S103) and then a bias of a sufficient magnitude is applied to the charging roller 6 so that the photosensitive drum 3 may be evenly charged (S104). Then, only the measurement region D(1) is exposed by laser to be set at the exposure potential Vl(1), and the DC bias discharge start voltage is detected by the DC bias discharge start voltage detection circuit 34 (S105). Similarly, the regions D(2) to D(7) (non-measurement regions) other than the measurement region D(1) are exposed by the laser to be set at the charging potential Vd(1) corresponding to the measurement region D(1), and the DC bias discharge start voltage is detected (S106). The detection of the discharge start voltage is performed in each of the measurement regions D(i) (i=1 to 7) in the longitudinal region of the photosensitive drum (i.e., the detection is also performed in the measurement regions D(2) to D(7)). When the detection is performed in the measurement region D(7) (i=7), it is determined that the detection ends (S107). When the detection is not performed in the measurement region D(7) (i≠7), the detection of the discharge start voltage is performed in a next measurement region D (S108).

Based on the result of the detection of the partial discharge start voltage in each of the measurement regions D(1) to D(7), the film thickness of the photosensitive drum 3 is calculated to obtain a measurement result (S109). Based on the measurement result, the unevenness of the film thickness is compared with a density unevenness threshold stored in the storage unit of the image forming apparatus. When the unevenness of the film thickness of the photosensitive drum 3 is smaller than the density unevenness threshold, it is determined that no problem occurs and thus a next printing operation starts (S110). On the other hand, when the unevenness of the film thickness is greater than the density unevenness threshold of the photosensitive drum 3 and thus the unevenness of the film thickness occurs in the longitudinal direction, it is determined that density unevenness may occur. Therefore, the suppression control of the unevenness of the film thickness of the drum is performed at subsequent rotation to correct image formation (S111).

In the first embodiment, the unevenness of the film thickness of the photosensitive drum is measured by detecting the partial discharge start voltage. When it is determined that the suppression control of the unevenness of the film thickness of the drum is necessary, control is necessarily input every subsequent rotation of a print job. When the unevenness of the film thickness of the photosensitive drum becomes even along with subsequent printing, sheet feeding histories, or the like, the suppression control of the unevenness of the film thickness of the drum stops.

In addition, the correction of the unevenness of the film thickness by the suppression control of the unevenness of the film thickness of the drum is effective not only to one part but to a plurality of measurement regions in the longitudinal direction of the photosensitive drum 3. In the first embodiment, the configuration in which the subsequent rotation of a print job is extended with respect to the measurement regions D(1) to D(5) to suppress the unevenness of the film thickness of the drum is described. However, depending on sheet feeding conditions or printing conditions, no problem occurs even if the number of measurement regions may be varied or correcting regions may separate from each other. For example, when it is determined that both ends of the photosensitive drum are scraped depending on sheet feeding conditions, it is possible to vary the regions D(2) to D(6) or the like as correcting regions.

(Confirmation of Effect)

In order to confirm the effect of the embodiment, an adverse effect on an image was confirmed in a method incorporating the detection of the unevenness of the film thickness in the longitudinal direction of the photosensitive drum 3 and the suppression control of the unevenness of the film thickness of the drum and in a comparative example as a conventional discharge current control method. Since the configuration of the comparative example is the same as that of the embodiment except that the suppression control of the unevenness of the film thickness of the drum based on the detection of the partial discharge start voltage and the detection result is not performed, its description will be omitted.

The following table 1 shows the results. O marks in the table indicate that no image failure occurs. X marks in the table indicate levels at which density unevenness occurs in a solid image. In the comparative example, unevenness occurs in an image after 30,000 sheets are fed. In the comparative example, the suppression control of the unevenness of the film thickness of the drum based on the detection of the partial discharge start voltage and the detection result is not performed. Therefore, when the sheets are continuously fed, the density unevenness continuously occurs until 40,000 sheets are fed. After feeding the 40,000 sheets, the exposure potential Vl was −160 V and the film thickness of the drum was 10 μm in the measurement regions D(1) to D(5). In addition, in the measurement regions D(6) and D(7), the exposure potential Vl was −210 V, and the film thickness of the drum was 6 μm.

Conversely, in the embodiment, the detection of the partial discharge start voltage is performed every 1,000 sheets to detect the unevenness of the film thickness in the longitudinal direction of the photosensitive drum 3. Therefore, it is found that an image level of the density unevenness is improved when the suppression control of the unevenness of the film thickness of the drum is performed after 25,000 sheets are fed. In the embodiment, no image failure due to density unevenness occurred until 40,000 sheets were fed. At this time, in the measurement regions D(1) to D(5), the exposure potential Vl was −190 V, and the film thickness of the drum was 8 μm. In addition, in the measurement regions D(6) and D(7), the exposure potential Vl was −210 V, and the film thickness of the drum was 6 μm. Based on the above results, it is found that the density unevenness in the longitudinal direction as an adverse effect on an image accompanied by the unevenness of the film thickness of the drum was effectively suppressed in the embodiment. Accordingly, in the embodiment, the detection of the partial discharge start voltage was performed, the unevenness of the film thickness of the photosensitive drum 3 was calculated based on the detection result, and the suppression control of the unevenness of the film thickness of the drum was performed based on the measurement result. Thus, the density unevenness was improved, and the effect was demonstrated.

TABLE 1

| The number of fed sheets ($\times 10^3$) | | 0 | 5 | 10 | 15 | 20 | 25 | 30 | 35 | 40 |
|---|---|---|---|---|---|---|---|---|---|---|
| Embodiment | Density | ○ | ○ | ○ | ○ | ○ | ○ | ○ | ○ | ○ |
| Comparative Example | Unevenness | ○ | ○ | ○ | ○ | ○ | ○ | x | x | x |

Second Embodiment

The first embodiment is characterized in that the suppression control of the unevenness of the film thickness in the longitudinal direction of the photosensitive drum is performed based on the detection result of detecting the discharge start voltage to suppress the density unevenness. A second embodiment of the present invention is characterized in that the unevenness of the film thickness in the longitudinal direction of the photosensitive drum is detected by the detection of the discharge start voltage and that an exposure amount of the photosensitive drum is variably controlled in the longitudinal direction based on the detection result. In the embodiment, the unevenness of the film thickness in the longitudinal direction of the photosensitive drum is detected by the detection of the discharge start voltage, and an exposure amount of the laser applied to the photosensitive drum is variably controlled for each region in the longitudinal direction based on the detection result to control the potential of the photosensitive drum. Thus, the occurrence of an image failure such as density unevenness is prevented. Matters of the second embodiment the same as those of the first embodiment will not described.

(Control after Detecting Film Thickness in Longitudinal Direction: Variable Control of Light Amount in Longitudinal Direction of Drum)

Figure 15:
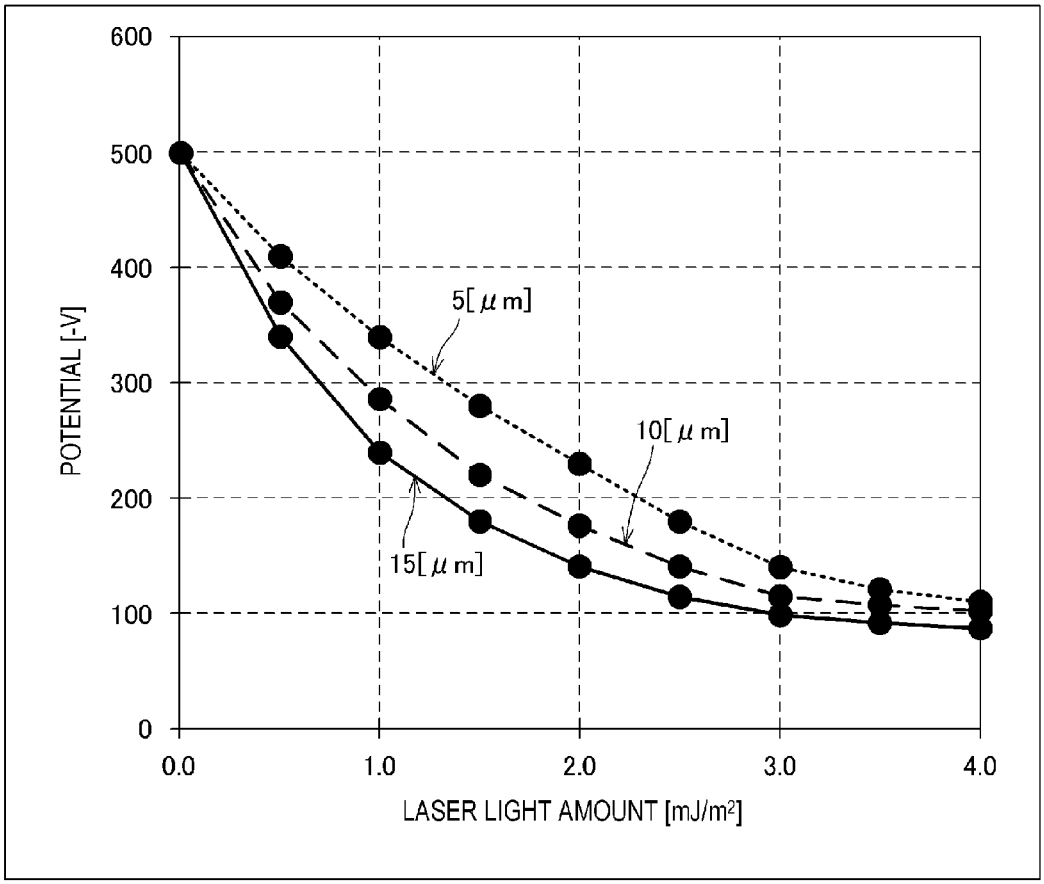
FIG. 15 is a graph showing the E-V curves of an exposure amount and a drum potential.

FIG. 15 is a graph showing the relationship between an exposure amount E and a surface potential V of the photosensitive drum 3 in the second embodiment. The horizontal axis indicates the laser exposure amount E, and the vertical axis indicates the potential V of the photosensitive drum. A bias applied to the charging roller 6 was set at −530 V. As shown in FIG. 15, it is confirmed that the potential of the photosensitive drum 3 with respect to the laser exposure amount changes as the film thickness of the photosensitive drum changes from 15 μm to 5 μm via 10 μm. Accordingly, by detecting the film thickness in the longitudinal direction of the photosensitive drum 3 based on the result of the detection of the partial discharge start voltage and appropriately varying the laser exposure amount only at a certain measurement region D, it is possible to make the exposure potential Vl of the photosensitive drum 3 even and secure an appropriate development contrast.

(Flowchart of Variable Control of Light Amount in Longitudinal Direction)

A description will be given, with reference to the flowchart of FIG. 16, of a method for detecting the unevenness of the film thickness in the longitudinal direction of the photosensitive drum 3 based on the result of the detection of the partial discharge start voltage and performing the variable control of the light amount in the longitudinal direction of the photosensitive drum 3 based on the detection result. Evaluation and examination conditions are the same as those of the first embodiment. Note that as for a detection method such as the detection of the partial discharge start voltage in the second embodiment, parts overlapping with the first embodiment will be omitted.

Figure 16:
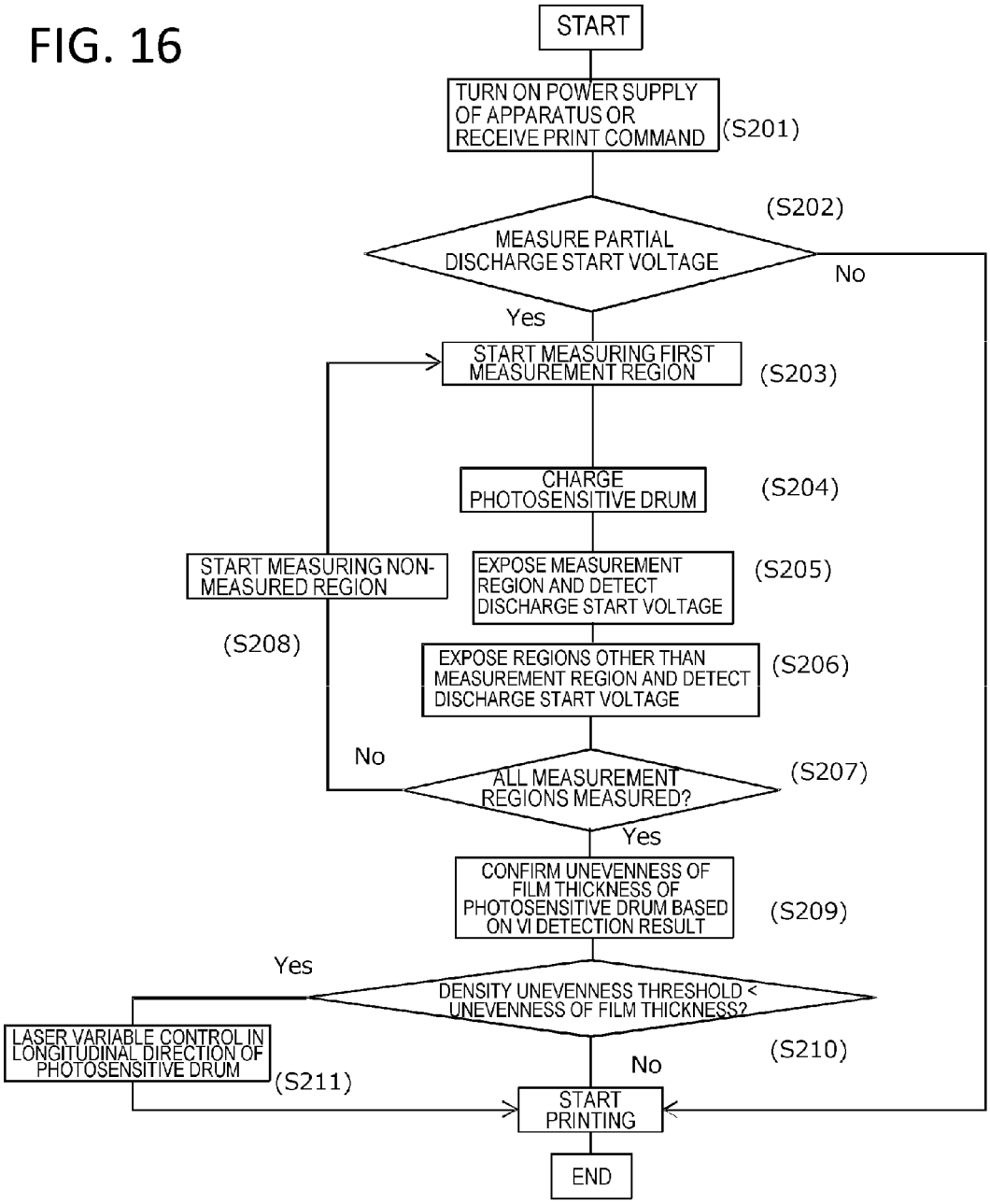
FIG. 16 is a flowchart of unevenness suppression control in a second embodiment of the present invention.

FIG. 16 is a flowchart for describing the detection of the partial discharge start voltage in the longitudinal direction of the photosensitive drum and the variable control of the light amount in the longitudinal direction of the drum based on the detection result of the unevenness of the film thickness of the drum in the embodiment. First, the power supply of the image forming apparatus 1 is turned on, or a print command is received (S201). Next, a determination is made as to whether the partial discharge start voltage is detected (S202). Since the unevenness of the film thickness in the longitudinal direction of the photosensitive drum 3 occurs with time, it is not necessary to measure the partial discharge start voltage at all times. In the embodiment, an image failure due to density unevenness accompanied by the scraping of the photosensitive drum was likely to occur every 1,000 sheets or so. Therefore, the partial discharge start voltage was measured once every 1,000 sheets. Meanwhile, a printing operation starts based on the result of measurement most recently performed. Note that a measurement frequency may be appropriately set according to the configuration of the image forming apparatus.

When the partial discharge start voltage is measured, the measurement region D(1) is determined (S203) and then a bias of a sufficient magnitude is applied to the charging roller 6 so that the photosensitive drum 3 may be evenly charged (S204). Then, the measurement region D(1) is exposed by laser to be set at the exposure potential Vl(1), and the DC bias discharge start voltage is detected by the DC bias discharge start voltage detection circuit 34 (S205). Similarly, the regions D(2) to D(7) (non-measurement regions) other than the measurement region D(1) are exposed by the laser to be set at the charging potential Vd(1) corresponding to the measurement region D(1), and the DC bias discharge start voltage is detected (S206). The detection of the discharge start voltage is performed in each of the measurement regions D(i) (i=1 to 7) in the longitudinal region of the photosensitive drum (i.e., the detection is also performed in the measurement regions D(2) to D(7)). When the detection is performed in the measurement region D(7) (i=7), it is determined that the detection ends (S207). When the detection is not performed in the measurement region D(7) (i≠7), the detection of the discharge start voltage is performed in a next measurement region D (S208).

Based on the result of the detection of the partial discharge start voltage in each of the measurement regions D(1) to D(7), the film thickness of the photosensitive drum 3 is calculated to obtain a measurement result (S209). Based on the measurement result, the unevenness of the film thickness is compared with the density unevenness threshold stored in the image forming apparatus. When the unevenness of the film thickness of the photosensitive drum 3 is smaller than the density unevenness threshold, it is determined that no problem occurs and thus a next printing operation starts (S210). On the other hand, when the unevenness of the film thickness is greater than the density unevenness threshold of the photosensitive drum 3 and thus the unevenness of the film thickness occurs in the longitudinal direction, it is determined that density unevenness may occur. Therefore, the variable control of a light amount is performed for each of the measurement regions in the longitudinal direction of the photosensitive drum 3 to correct image formation, and an appropriate exposure potential Vl is formed to perform image formation (S211).

The correction of the unevenness of the film thickness by the variable control of the light amount in the longitudinal direction of the drum is effective not only to one part but to a plurality of measurement regions in the longitudinal direction of the photosensitive drum 3. In the second embodiment, a light amount of the laser exposed to each of the measurement regions D(1) to D(5) and the measurement regions D(6) and D(7) is varied. Thus, even if the unevenness of the film thickness of the drum occurs, it becomes possible to make the exposure potential Vl even.

(Confirmation of Effect)

In order to confirm the effect of the embodiment, the confirmation of the effect was performed like the first embodiment. Since a comparative example is the same as the embodiment except that the variable control of the light amount in the longitudinal direction of the drum is not performed, its description will be omitted. Since the evaluation and measurement of an image were performed like the first embodiment, their descriptions will be omitted.

The examination results of density unevenness were the same as those of table 1 described in the first embodiment. In the comparative example, like the first embodiment, unevenness occurs in an image after 30,000 sheets are fed. In the comparative example, the variable control of the unevenness of the film thickness of the drum based on the detection of the partial discharge start voltage and the detection result is not performed. Therefore, when the sheets are continuously fed, the density unevenness continuously occurs until 40,000 sheets are fed. After feeding 40,000 sheets, a laser exposure amount was evenly set at 2.0 mJ/m$^2$ in the entire region of the photosensitive drum 3. At this time, the exposure potential Vl of the measurement regions D(1) to D(5) was −160 V and the film thickness of the drum was 10 μm. In addition, the exposure potential Vl of the measurement regions D(6) and D(7) was −210 V, and the film thickness of the drum was 6 μm.

Conversely, in the embodiment, the detection of the partial discharge start voltage is performed every 1,000 sheets to determine the variable control of the laser exposure amount of the photosensitive drum 3. In the embodiment, it is found that an image level of the density unevenness is improved when the variable control of the laser exposure amount is performed after 25,000 sheets are fed. In the embodiment, no image failure due to density unevenness occurred until 40,000 sheets were fed. At this time, in the measurement regions D(1) to D(5), the exposure potential Vl was −150 V with a laser exposure amount of 2.4 mJ/m$^2$, and the film thickness of the drum was 10 μm. In addition, in the measurement regions D(6) and D(7), the exposure potential Vl was −150 V with a laser exposure amount of 2.8 mJ/m$^2$, and the film thickness of the drum was 6 μm. Based on the above results, it is found in the embodiment that the density unevenness in the longitudinal direction as an adverse effect on an image is effectively suppressed by variably controlling the laser exposure amount even if the unevenness of the film thickness occurs in the longitudinal direction of the photosensitive drum 3. Accordingly, in the embodiment, the detection of the partial discharge start voltage was performed, the unevenness of the film thickness of the photosensitive drum 3 was calculated based on the detection result, and the variable control of the light amount in the longitudinal direction of the drum was performed based on the measurement result. Thus, the density unevenness was improved, and the effect was demonstrated.

However, depending on sheet feeding conditions or printing conditions, the number of measurement regions may be varied or correcting regions may separate from each other. For example, when it is determined that both ends of the photosensitive drum 3 are scraped depending on sheet feeding conditions, it is possible to vary the correcting regions D(1), D(7), and D(2) to D(6) as correcting regions in which a laser exposure amount is corrected. In addition, in order to change an exposure amount in the longitudinal direction of the photosensitive drum 3, laser power is made variable to change the exposure amount and make the exposure potential Vl even in the embodiment. However, any method may be used so long as the same effect is obtained. That is, it is only necessary to make the exposure potential of the photosensitive drum 3 even in the longitudinal direction. For example, even if the same laser power is used, a light emission time or a dither pattern may be controlled to be used.

In addition, in the embodiment, the laser exposure amount is changed in the longitudinal region of the photosensitive drum 3 based on the result of the detection of the partial discharge start voltage. Therefore, it is possible to shorten a control time than the suppression control of the unevenness of the film thickness in the longitudinal direction performed in the first embodiment. Moreover, the laser exposure amount may be varied to evenly form the exposure potential Vl in the longitudinal region of the photosensitive drum 3.

Therefore, it is possible to perform image formation by almost the same potential control as that of the initial state of the photosensitive drum. Thus, the effect of maintaining density or the like is obtained.

Third Embodiment

A third embodiment of the present invention is characterized in that the unevenness of the film thickness in the longitudinal direction of the photosensitive drum 3 is detected by the detection of the discharge start voltage and the service life of the drum is determined based on the determination result and notified to a user. Note that the parts of configurations overlapping with the first and second embodiments will be omitted.

(Control after Detecting Film Thickness in Longitudinal Direction: Detection Control of Service Life of Drum)

The first embodiment is characterized in that the suppression control of the unevenness of the film thickness of drum is performed to suppress the density unevenness. In addition, the second embodiment is characterized in that the variable control of the light amount in the longitudinal direction is performed to suppress the density unevenness. Normally, a user is notified of the fact that a remaining amount of the toner inside the development container becomes zero or a prescribed threshold or less after the consumption of the toner, and the operation of the image forming apparatus stops. However, when the sheets are continuously fed beyond the assumed number of sheets to be used, a scraping amount in the longitudinal direction of the photosensitive drum 3 increases. When the film thickness of the photosensitive drum 3 becomes smaller than a certain threshold, an entire region in the longitudinal direction may not be evenly charged, which results in the occurrence of an image failure such as fogging. When the photosensitive drum 3 in such a state is left as it is, there is a case that waste toner puncture (where waste toner exceeding the capacity of a waste toner container is generated), the leakage of the toner into the image forming apparatus, or the like occurs. Therefore, it is necessary to accurately notify the user of the service life of the photosensitive drum 3.

As for measurement, 50,000 CS680 A6 sheets were intermittently fed two by two at a printing ratio of 4%, and one solid white image sheet and one solid black image sheet were printed every 5,000 sheets. The sheets were set to be conveyed along a region close to one side in the longitudinal direction of the photosensitive drum 3. As an adverse effect on an image caused by the scraping unevenness of the photosensitive drum 3, density unevenness in the longitudinal direction and fogging were confirmed on an image. In order to confirm the adverse effect on the image, Xerox Business 4200 was used. As the surface potentials of the photosensitive drum 3 in an initial state, the charging potential Vd was set at −500 V, the exposure potential Vl was set at −150 V, and the development bias Vdc was set at −350 V.

(Flowchart of Detection Control of Service Life of Drum)

A description will be given, with reference to the flowchart of FIG. 17, of a method for detecting the unevenness of the film thickness in the longitudinal direction of the photosensitive drum 3 based on the detection result of the detection of the partial discharge start voltage and detecting the service life of the photosensitive drum in the embodiment. Evaluation and examination conditions are the same as those of the first and second embodiments. Note that as for a detection method such as the detection of the partial discharge start voltage in the third embodiment, parts overlapping with the first and second embodiments will be omitted.

Figure 17:
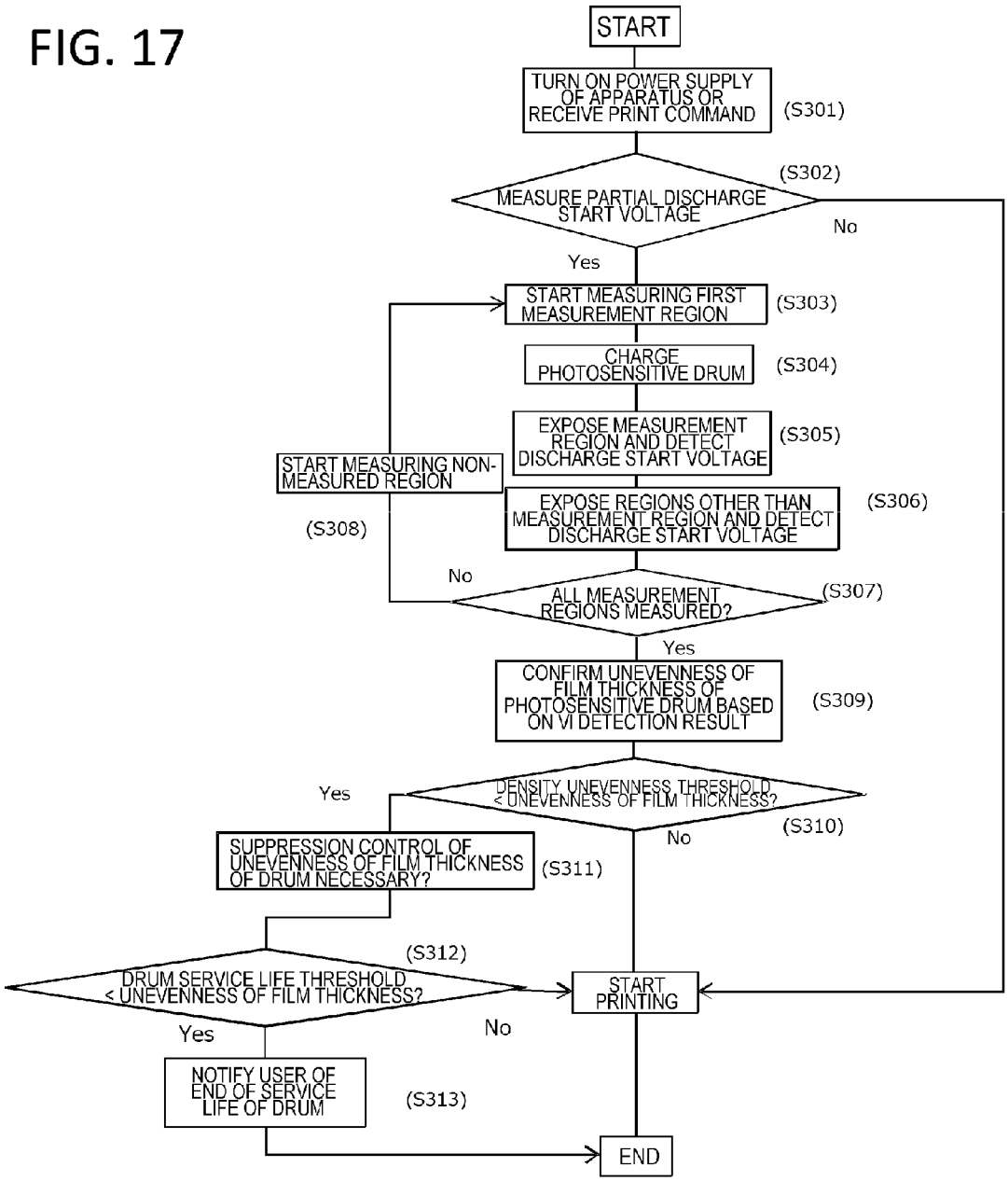
FIG. 17 is a flowchart of unevenness suppression control in a third embodiment of the present invention.
Figure 18:
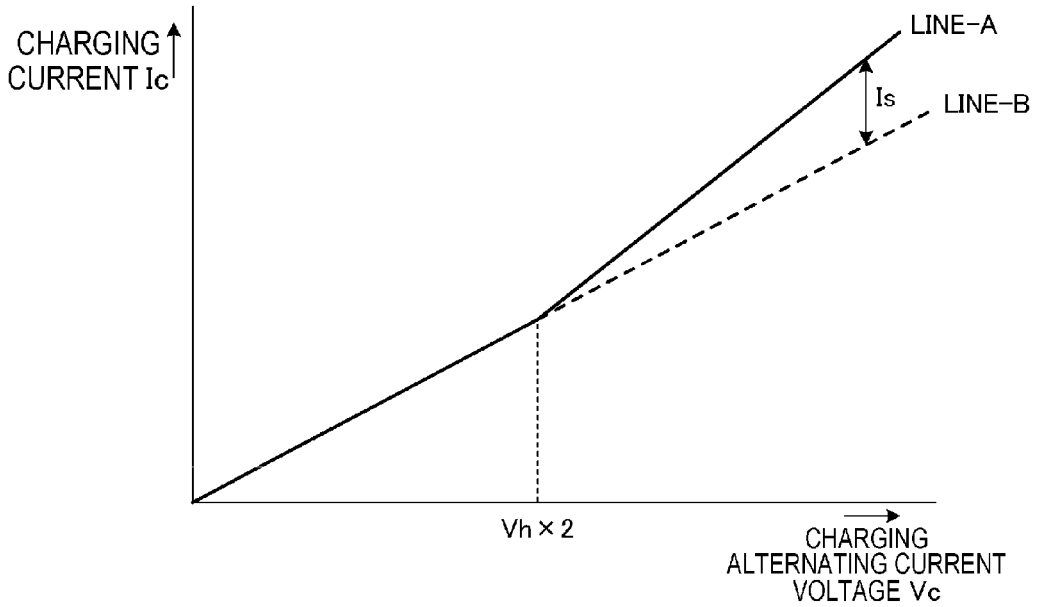
FIG. 18 is a schematic diagram of the V-I characteristics of a charging member.

FIG. 17 is a flowchart for describing the detection of the partial discharge start voltage in the longitudinal direction of the photosensitive drum and the detection control of the service life of the drum based on the detection result of the unevenness of the film thickness of the drum in the embodiment. First, since the steps (S301 to S309) of calculating the film thickness of the photosensitive drum and obtaining the measurement result based on the result of the detection of the partial discharge start voltage in each of the measurement regions are the same as the steps (S101 to S109) of the first embodiment, their descriptions will be omitted. Based on the measurement result, the unevenness of the film thickness is compared with the density unevenness threshold stored in the storage unit of the image forming apparatus. When the unevenness of the film thickness of the photosensitive drum 3 is smaller than the density unevenness threshold, it is determined that no problem occurs and thus a next printing operation starts (S310). On the other hand, when the unevenness of the film thickness greater than the density unevenness threshold of the photosensitive drum 3 occurs in the longitudinal direction, it is determined that density unevenness may occur. Therefore, the suppression control of the unevenness of the film thickness of the drum is performed at rotation after image formation to correct next image formation (S311).

In addition, when the suppression control of the unevenness of the film thickness of the drum is necessary, the film thickness of the photosensitive drum 3 is compared with the service life threshold of the photosensitive drum stored in the image forming apparatus based on the measurement result. When the film thickness of the photosensitive drum 3 is greater than the threshold, it is determined that no problem occurs and thus a printing operation starts (S312). On the other hand, when the unevenness of the film thickness greater than the service life threshold of the drum occurs in the longitudinal direction, the operation stops and the user is notified of the fact that the drum has come to the end of the service life (S313). The measurement of the regions by the detection control of the service life of the drum is effective not only to one part but to a plurality of measurement regions in the longitudinal direction of the photosensitive drum 3. In the third embodiment, the detection control of the service life of the drum is performed with respect to the measurement regions D(6) and D(7) to perform the determination.

(Confirmation of Effect)

In order to confirm the effect of the embodiment, an adverse effect on an image was confirmed in a method incorporating the above detection control and a comparative example as a conventional discharge current control method. Since the configuration of the comparative example is the same as that of the embodiment except that the detection control of the service life of the drum based on the detection of the partial discharge start voltage and the detection result is not performed, its description will be omitted.

The following table 2 shows the results. As for density unevenness, fogging due to a charging failure, and the leakage of the toner on an image level, O marks in the table indicate that no image failure occurs while X marks in the table indicate that an image failure occurs and the toner leaks into the image forming apparatus.

TABLE 2

| The number of fed sheets ($\times 10^3$) | | 0 | 5 | 10 | 15 | 20 | 25 | 30 | 35 | 40 | 45 | 50 |
|---|---|---|---|---|---|---|---|---|---|---|---|---|
| Embodiment | Leakage of toner | ○ | ○ | ○ | ○ | ○ | ○ | ○ | ○ | ○ | — | — |
| | Fogging | ○ | ○ | ○ | ○ | ○ | ○ | ○ | ○ | ○ | — | — |
| | Density Unevenness | ○ | ○ | ○ | ○ | ○ | ○ | ○ | ○ | ○ | — | — |
| Comparative Example | Leakage of toner | ○ | ○ | ○ | ○ | ○ | ○ | ○ | ○ | ○ | ○ | x |
| | Fogging | ○ | ○ | ○ | ○ | ○ | ○ | ○ | ○ | ○ | x | x |
| | Density Unevenness | ○ | ○ | ○ | ○ | ○ | ○ | x | x | x | x | x |

The results show that unevenness occurred in an image after 30,000 sheets were fed in the comparative example. In the comparative example, the suppression control of the unevenness of the film thickness of the drum and the detection control of the service life of the drum based on the detection of the partial discharge start voltage and the detection result were not performed. Therefore, when the sheets are continuously fed, the density unevenness was deteriorated until 50,000 sheets are fed. In addition, fogging was caused on the image after 45,000 sheets were fed, and the leakage of the toner occurred after 50,000 sheets were fed. As a result, the toner was leaked into the image forming apparatus, and the image forming apparatus was contaminated. In the measurement regions D(1) to D(5) after 50,000 sheets were fed, the exposure potential Vl was −210 V, and the film thickness of the drum was 6 μm. In addition, in the measurement regions D(6) and D(7), the exposure potential Vl was −280 V, and the film thickness of the drum was 2 μm. In the measurement regions D(6) and D(7), fogging was caused due to a charging failure, and the charging potential Vd was −390 V.

Conversely, in the embodiment, the detection control of the service life of the drum is performed based on the detection of the partial discharge start voltage and the detection result every 1,000 sheets. By the detection of the unevenness of the film thickness in the longitudinal direction of the photosensitive drum 3 based on the detection of the partial discharge start voltage, it was determined in the embodiment that the drum had come to the end of the service life when 44,000 sheets were fed and the detection result was notified to stop image formation. From these results, in the embodiment, the detection of the partial discharge start voltage was performed, the unevenness of the film thickness of the photosensitive drum 3 was calculated based on the detection result, and the suppression control of the unevenness of the film thickness of the drum was performed based on the measurement result. Thus, the density unevenness was improved. In addition, by the detection control of the service life of the drum, a fatal adverse effect on an image and toner contamination due to waste toner puncture, the leakage of the toner, or the like in the image forming apparatus were prevented. Accordingly, in the embodiment, the detection of the partial discharge start voltage was performed, the unevenness of the film thickness of the photosensitive drum 3 was calculated based on the detection result, and the detection control of the service life of the drum was performed based on the measurement result. Thus, the service life of the drum was accurately notified, and the effect was demonstrated.

Fourth Embodiment

In the first embodiment, the detection of the discharge start voltage is performed using the storage memory or the like of the image forming apparatus, the unevenness of the film thickness of the photosensitive drum 3 is calculated based on the detection result, and the suppression control of the unevenness of the film thickness of the drum is performed based on the measurement result. A fourth embodiment of the present invention is characterized in that a non-volatile memory is used in a detection unit to enhance the freedom degree of control or increase a speed compared with the first embodiment. Note that the parts of the constituents of the fourth embodiment overlapping with those of the first to third embodiments will be omitted.

The image forming apparatus 1 according to the fourth embodiment is characterized in that the non-volatile memory 9 provided in the process cartridge 2 is used in the suppression control of the unevenness of the film thickness of the drum. Various information on the photosensitive drum 3 at manufacturing necessary for performing the above control is stored in advance in the non-volatile memory 9 provided in the process cartridge attachable/detachable to/from the apparatus body. The above control is performed using the storage information. Thus, it becomes possible to correct sensitivity deflection or film thickness deflection due to the manufacturing of the photosensitive drum 3 from an initial state. Accordingly, it becomes possible to perform more accurate control and enhance the freedom degree of the control or increase a speed.

Specifically, the contents of the suppression control of the unevenness of the film thickness of the photosensitive drum 3 are changed according to use conditions or use environments. In addition, when it is desired to reflect use histories on the control, the number of times or the contents of the past suppression control of the unevenness of the film thickness, the histories of the output values of a charging current, or the like is stored in advance in the non-volatile memory 9. In addition, by storing printing histories and the histories of the types of feeding sheets in the non-volatile memory 9 and appropriately changing measurement regions according to the histories, it may be possible to perform the adjustment and change of control contents.

Note that each of the above embodiments describes the image forming apparatus having the configuration in which a toner image (developer image) formed on the photosensitive drum is directly transferred onto the recording material serving as a transferred body. However, the configuration of the image forming apparatus is not particularly limited. For example, the present invention may also be applied to an image forming apparatus (color laser printer or the like) in which toner images of different colors formed by a plurality of image forming sections are overlapped and transferred onto an intermediate transfer body serving as a transferred body to form a color toner image and then the color toner image is transferred onto a recording material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-197846, filed Oct. 5, 2015, which is hereby incorporated by reference herein in its entirety.

What is claimed is:

1. An image forming apparatus comprising:

a photosensitive body on which an electrostatic image used to form a developer image to be transferred onto a recording material is formed;

a charging member that is arranged close to or in contact with the photosensitive body and charges the photosensitive body with a voltage applied thereto;

a voltage application unit that applies the voltage to the charging member;

an exposure unit that exposes the photosensitive body;

a detection unit that detects a current value of a current flowing to the charging member;

an acquisition portion that acquires, based on the current value detected by the detection unit, a discharge start voltage value, at which a discharge starts between the photosensitive body and the charging member, in a voltage value of the voltage applied to the charging member, the discharge start voltage value being acquired from at least one of a plurality of measurement regions set by dividing an image forming region of the photosensitive body, in which the electrostatic image is formed, into a plurality of regions in a longitudinal direction orthogonal to a conveyance direction of the recording material; and a control portion that performs unevenness suppression control to reduce unevenness, in the longitudinal direction, of density of the developer image transferred onto the recording material based on an unevenness of film thickness of a photosensitive layer the discharge start voltage value acquired by the acquisition portion, wherein the acquisition portion acquires a first discharge start voltage value based on the current value detected by the detection unit when, after the voltage application unit applies a voltage of a first voltage value to the charging member, the exposure unit exposes only one measurement region, from which the discharge start voltage value is to be acquired, among the plurality of measurement regions to be set at a prescribed exposure potential and thereafter the voltage application unit applies, to the charging member, a voltage of a second voltage value having an absolute value closer to the first voltage value than the prescribed exposure potential, acquires a second discharge start voltage value based on the current value detected by the detection unit when, after the voltage application unit applies the voltage of the first voltage value to the charging member, the exposure unit exposes only measurement regions other than the one measurement region among the plurality of measurement regions to be set at the prescribed exposure potential and thereafter the voltage application unit applies, to the charging member, a voltage of a third voltage value having an absolute value closer to the prescribed exposure potential than the first voltage value, acquires an exposure potential in the one measurement region after the exposure by the exposure unit based on the first discharge start voltage value and the second discharge start voltage value, and acquires film thickness of a photosensitive layer in the one measurement region based on the exposure potential.

2. The image forming apparatus according to claim 1, wherein the second voltage value has an absolute value greater than an absolute value of the first voltage value.

3. The image forming apparatus according to claim 1, wherein the third voltage value has an absolute value smaller than an absolute value of the prescribed exposure potential.

4. The image forming apparatus according to claim 1, wherein, when the exposure potential of the one measurement region D(i) is indicated by Vl(i), the first discharge start voltage value is indicated by Vth1(i), the second discharge start voltage value is indicated by Vth2(i), and the first voltage value is indicated by Vd, the acquisition portion acquires the exposure potential based on a relationship of $Vl(i)=-(Vth1(i)+Vth2(i))-Vd$.

5. The image forming apparatus according to claim 1, wherein, as the unevenness suppression control, the control portion performs control to scrape a photosensitive layer based on the discharge start voltage value in each of the plurality of measurement regions such that a difference in film thickness of the photosensitive layer between the plurality of measurement regions becomes small.

6. The image forming apparatus according to claim 5, wherein, as the control to scrape the photosensitive layer, the control portion controls the voltage application unit and the exposure unit such that the voltage application unit applies the voltage to the charging member to charge the photosensitive body, the exposure unit thereafter exposes only a measurement region having relatively large film thickness among the plurality of measurement regions, and the voltage application unit thereafter applies the voltage to the charging member to generate the discharge between the charging member and the photosensitive body.

7. The image forming apparatus according to claim 5, wherein the control portion performs the unevenness suppression control when the difference in the film thickness between a measurement region having relatively large film thickness and a measurement region having relatively small film thickness becomes greater than or equal to a second threshold in regions having film thickness less than or equal to a first threshold among the plurality of measurement regions.

8. The image forming apparatus according to claim 1, wherein, as the unevenness suppression control, the control portion performs control to adjust an exposure amount of the exposure unit based on the discharge start voltage value in each of the plurality of measurement regions such that a difference in exposure potential between the plurality of measurement regions after the exposure by the exposure unit becomes small.

9. The image forming apparatus according to claim 8, wherein, as the control to adjust the exposure amount, the control portion controls the exposure unit such that the exposure amount is increased as film thickness is smaller.

10. The image forming apparatus according to claim 1, further comprising:

a notification unit that issues a notification to urge an exchange of the photosensitive body when, after the control portion performs the unevenness suppression control, a difference in film thickness between a measurement region having relatively large film thickness and a measurement region having relatively small film thickness among the plurality of measurement regions exceeds a prescribed service life threshold.

11. The image forming apparatus according to claim 1, wherein the charging member is a charging member used to charge the photosensitive body at a prescribed potential before the exposure unit performs an exposure to form the electrostatic image on the photosensitive body in an image forming step of forming an image on the recording material.

12. The image forming apparatus according to claim 1, wherein the voltage applied to the charging member by the voltage application unit is a direct current voltage.

13. The image forming apparatus according to claim 1, wherein at least the photosensitive body is configured to be attachable/detachable to/from an apparatus body of the image forming apparatus as a process cartridge provided with a non-volatile memory.

14. The image forming apparatus according to claim 1, wherein the control portion performs the unevenness suppression control based on unevenness, in the longitudinal direction, of film thickness of a photosensitive layer of the photosensitive body acquired based on the discharge start voltage value acquired by the acquisition portion.

15. An image forming apparatus comprising:

a photosensitive body on which an electrostatic image used to form a developer image to be transferred onto a recording material is formed;

a transfer member that is arranged close to or in contact with the photosensitive body and charges the photosensitive body with a voltage applied thereto;

a voltage application unit that applies the voltage to the transfer member;

an exposure unit that exposes the photosensitive body;

a detection unit that detects a current value of a current flowing to the transfer member;

an acquisition portion that acquires, based on the current value detected by the detection unit, a discharge start voltage value, at which a discharge starts between the photosensitive body and the transfer member, in a voltage value of the voltage applied to the transfer member, the discharge start voltage value being acquired from at least one of a plurality of measurement regions set by dividing an image forming region of the photosensitive body, in which the electrostatic image is formed, into a plurality of regions in a longitudinal direction orthogonal to a conveyance direction of the recording material; and a control portion that performs unevenness suppression control to reduce unevenness, in the longitudinal direction, of density of the developer image transferred onto the recording material based on an unevenness of film thickness of a photosensitive layer the discharge start voltage value acquired by the acquisition portion, wherein the acquisition portion acquires a first discharge start voltage value based on the current value detected by the detection unit when, after the voltage application unit applies a voltage of a first voltage value to the transfer member, the exposure unit exposes only one measurement region, from which the discharge start voltage value is to be acquired, among the plurality of measurement regions to be set at a prescribed exposure potential and thereafter the voltage application unit applies, to the transfer member, a voltage of a second voltage value having an absolute value closer to the first voltage value than the prescribed exposure potential, acquires a second discharge start voltage value based on the current value detected by the detection unit when, after the voltage application unit applies the voltage of the first voltage value to the transfer member, the exposure unit exposes only measurement regions other than the one measurement region among the plurality of measurement regions to be set at the prescribed exposure potential and thereafter the voltage application unit applies, to the transfer member, a voltage of a third voltage value having an absolute value closer to the prescribed exposure potential than the first voltage value, acquires an exposure potential in the one measurement region after the exposure by the exposure unit based on the first discharge start voltage value and the second discharge start voltage value, and acquires film thickness of a photosensitive layer in the one measurement region based on the exposure potential, and wherein the transfer member is a member to which the voltage is applied to generate a transfer bias between the transfer member and the photosensitive body in a step of transferring the developer image formed on the photosensitive body onto the recording material.

16. The image forming apparatus according to claim 15, wherein the second voltage value has an absolute value greater than an absolute value of the first voltage value.

17. The image forming apparatus according to claim 15, wherein the third voltage value has an absolute value smaller than an absolute value of the prescribed exposure potential.

18. The image forming apparatus according to claim 15, wherein, when the exposure potential of the one measurement region D(i) is indicated by Vl(i), the first discharge start voltage value is indicated by Vth1(i), the second discharge start voltage value is indicated by Vth2(i), and the first voltage value is indicated by Vd, the acquisition portion acquires the exposure potential based on a relationship of $Vl(i)=-(Vth1(i)+Vth2(i))-Vd$.

19. The image forming apparatus according to claim 15, wherein, as the unevenness suppression control, the control portion performs control to scrape a photosensitive layer based on the discharge start voltage value in each of the plurality of measurement regions such that a difference in film thickness of the photosensitive layer between the plurality of measurement regions becomes small.

20. The image forming apparatus according to claim 19, wherein, as the control to scrape the photosensitive layer, the control portion controls the voltage application unit and the exposure unit such that the voltage application unit applies the voltage to the transfer member to charge the photosensitive body, the exposure unit thereafter exposes only a measurement region having relatively large film thickness among the plurality of measurement regions, and the voltage application unit thereafter applies the voltage to the transfer member to generate the discharge between the transfer member and the photosensitive body.

21. The image forming apparatus according to claim 19, wherein the control portion performs the unevenness suppression control when the difference in the film thickness between a measurement region having relatively large film thickness and a measurement region having relatively small film thickness becomes greater than or equal to a second threshold in regions having film thickness less than or equal to a first threshold among the plurality of measurement regions.

22. The image forming apparatus according to claim 15, wherein, as the unevenness suppression control, the control portion performs control to adjust an exposure amount of the exposure unit based on the discharge start voltage value in each of the plurality of measurement regions such that a difference in exposure potential between the plurality of measurement regions after the exposure by the exposure unit becomes small.

23. The image forming apparatus according to claim 22, wherein, as the control to adjust the exposure amount, the control portion controls the exposure unit such that the exposure amount is increased as film thickness is smaller.

24. The image forming apparatus according to claim 15, further comprising:

a notification unit that issues a notification to urge an exchange of the photosensitive body when, after the control portion performs the unevenness suppression control, a difference in film thickness between a measurement region having relatively large film thickness and a measurement region having relatively small film thickness among the plurality of measurement regions exceeds a prescribed service life threshold.

25. The image forming apparatus according to claim 15, wherein the voltage applied to the transfer member by the voltage application unit is a direct current voltage.

26. The image forming apparatus according to claim 15, wherein at least the photosensitive body is configured to be attachable/detachable to/from an apparatus body of the image forming apparatus as a process cartridge provided with a non-volatile memory.

27. The image forming apparatus according to claim 15, wherein the control portion performs the unevenness suppression control based on unevenness, in the longitudinal direction, of film thickness of a photosensitive layer of the photosensitive body acquired based on the discharge start voltage value acquired by the acquisition portion.

* * * * *